US008930184B2

(12) United States Patent
Sudo et al.

(10) Patent No.: US 8,930,184 B2
(45) Date of Patent: Jan. 6, 2015

(54) SIGNAL BANDWIDTH EXTENDING APPARATUS

(75) Inventors: Takashi Sudo, Fuchu (JP); Masataka Osada, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1274 days.

(21) Appl. No.: 12/558,959

(22) Filed: Sep. 14, 2009

(65) Prior Publication Data

US 2010/0198588 A1 Aug. 5, 2010

(30) Foreign Application Priority Data

Feb. 2, 2009 (JP) ..... P2009-021717

(51) Int. Cl.
*G10L 19/00* (2013.01)
*G10L 21/038* (2013.01)

(52) U.S. Cl.
CPC ..... *G10L 21/038* (2013.01)
USPC ..... 704/205; 704/206; 704/210; 704/214; 704/215; 704/216

(58) Field of Classification Search
USPC ..... 704/205, 206, 207, 210, 214, 215, 216
See application file for complete search history.

(56) References Cited

U.S. PATENT DOCUMENTS

| | | | | |
|---|---|---|---|---|
| 7,630,881 | B2 | 12/2009 | Iser et al. | |
| 8,190,429 | B2 * | 5/2012 | Iser et al. | 704/223 |
| 2002/0138268 | A1 * | 9/2002 | Gustafsson | 704/258 |
| 2003/0050786 | A1 * | 3/2003 | Jax et al. | 704/500 |

FOREIGN PATENT DOCUMENTS

| | | | |
|---|---|---|---|
| JP | 2002-082685 | A | 3/2002 |
| JP | 2002-162982 | A | 6/2002 |
| JP | 2003-140696 | A | 5/2003 |
| JP | 2005-321821 | A | 11/2005 |
| JP | 2006-085176 | A | 3/2006 |

OTHER PUBLICATIONS

GSM06.94 ver 7.1.1, also referred to ETSI EN 301 708, Voice Activity Detector (VAD) for Adaptive Multi-Rate (AMR) speech traffic channels, Dec. 1999.*

Japanese Office Action dated May 31, 2011 (and English translation thereof) in counterpart Japanese Application No. 2009-021717.

Japanese Office Action dated Nov. 1, 2011 (and English translation thereof) in counterpart Japanese Application No. 2009-021717.

Japanese Notice of Allowance dated Feb. 7, 2012 (and English translation thereof) in counterpart Japanese Application No. 2009-021717.

* cited by examiner

*Primary Examiner* — Qi Han
(74) *Attorney, Agent, or Firm* — Holtz, Holtz, Goodman & Chick PC

(57) ABSTRACT

A signal bandwidth extending apparatus including: a bandwidth extending section configured to extend a frequency bandwidth of a target signal, the target signal included in an input signal; a calculating section configured to calculate a degree of the target signal included in the input signal; and a controller configured to change a method of extending the frequency bandwidth by the bandwidth extending section according to a result of the calculating section.

6 Claims, 19 Drawing Sheets

SIGNAL BANDWIDTH EXTENDING APPARATUS

CROSS-REFERENCE TO RELATED APPLICATIONS

The entire disclosure of Japanese Patent Application No. 2009-021717 filed on Feb. 2, 2009, including specification claims, drawings and abstract is incorporated herein by reference in its entirety.

BACKGROUND

1. Field of the Invention

One aspect of the invention relates to a signal bandwidth extending apparatus which converts a signal, such as speech, music, or audio with limited bandwidth, into a wideband signal.

2. Description of the Related Art

When the bandwidth of the signal (input signal) such as speech, music, or audio is extended to a wideband signal, in order for the sound to be heard not artificially but naturally, there is a need to properly change the signal processing method used for extending a frequency band so as it corresponds to the signal (target signal) of the bandwidth which is to be extended and is included in the input signals.

As a related bandwidth extension processing method, there are a scheme in which the frequency band is extended after performing a linear prediction analysis on the speech when the target signal is a speech, a scheme in which the frequency band is extended after performing a frequency domain transformation on the music or the audio when the target signal is music or audio, and a scheme in which the frequency band to be extended is switched based on whether or not the speech is a voiced sound or an unvoiced sound even when the target signal is a speech (see JP-A-002-82685, for instance).

In the related signal bandwidth extending apparatuses, since the bandwidth extension is performed over the entire section even when the target signal and other signals (non-target signals) than the target signal are mixed in the input signal, heavy computational load is needed.

SUMMARY

According to an aspect of the invention, there is provided a signal bandwidth extending apparatus including: a bandwidth extending section configured to extend a frequency band of a target signal, the target signal included in an input signal; a calculating section configured to calculate a degree of the target signal included in the input signal; and a controller configured to change a method of extending the frequency band by the bandwidth extending section according to a result of the calculating section.

BRIEF DESCRIPTION OF THE DRAWINGS

Embodiment may be described in detail with reference to the accompanying drawings, in which.

DETAILED DESCRIPTION OF THE EMBODIMENTS

In the following, exemplary embodiments of the invention will be described with reference to the accompanying drawings.

First Embodiment

Figure 1A:
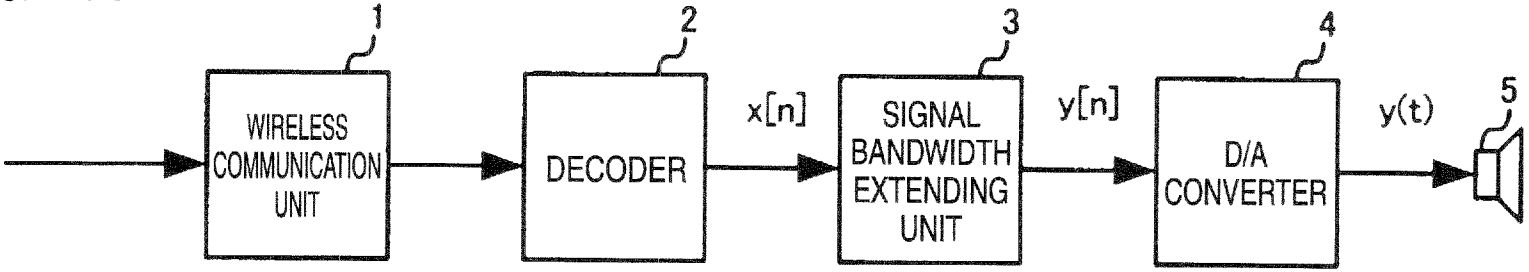
FIGS. 1A and 1B are exemplary circuit block diagrams illustrating a configuration of a communication apparatus and a digital audio player according to an embodiment of the invention.

FIG. 1A shows a configuration of a communication apparatus according to a first embodiment of the invention. The communication apparatus shown in this drawing shows a reception system of a wireless communication apparatus such as a mobile telephone, which is provided with a wireless communication unit 1, a decoder 2, a signal bandwidth extending unit 3, a digital/analog (D/A) converter 4, and a speaker 5.

The wireless communication unit 1 performs wireless communication with a wireless base station which is accommodated in a mobile communication network, which communicates with a counterpart communication apparatus by establishing a communication link therewith via the wireless base station and the mobile communication network.

The decoder 2 decodes input data that the wireless communication unit 1 receives from the counterpart communication apparatus in a predetermined processing unit (1 frame=N samples), and obtains digital input signals x[n] (n=0, 1, . . . , 1). In this case, the input signals x[n] are signals in a narrowband in which a sampling frequency is fs [Hz] and which is limited in the bandwidth from fs_nb_low [Hz] to fs_nb_high [Hz]. The digital input signals x[n] obtained in this way are output to the signal bandwidth extending unit 3 in frame units.

The signal bandwidth extending unit 3 performs a bandwidth extending process on the input signals x[n] (n=0, 1, . . . , N−1) in frame units, and outputs the resulting signals as output signals y[n] which are extended in bandwidth from fs_wb_low [Hz] to fs_wb_high [Hz]. At this time, the sampling frequency of the output signals y[n] remains to the sampling frequency fs [Hz] of the decoder 2 or is changed to a higher sampling frequency of fs' [Hz].

Here, it is assumed that the wideband output signal y[n] at the sampling frequency fs' [Hz] is obtained in frame units by the signal bandwidth extending unit 3. In this case, fs_wb_low≤fs_nb_low<fs_nb_high<fs/2≤fs_wb_high<fs'/2 is satisfied. Further, in the following description, in order to exemplify the low-frequency bandwidth extension and the high-frequency bandwidth extension, fs_wb_low<fs_nb_low and fs_nb_high<fs_wb_high are assumed, for example fs=8000 [Hz], fs'=16000 [Hz], fs_nb_low=340 [Hz], fs_nb_high=3950 [Hz], fs_wb_low=50 [Hz], and fs_wb_high=7950 [Hz], In addition, here one frame is assumed to correspond to N samples (N=160). The frequency band with limited bandwidth, the sampling frequency, and the frame size are not limited by the setting values described above. The exemplary configuration of the signal bandwidth extending unit 3 will be described in detail later.

The D/A converter 4 converts the wideband output signal y[n] into an analog signal y(t) and outputs the analog signal y(t) to the speaker 5. The speaker 5 outputs the Output signal y(t) which is the analog signal to an acoustic space.

Figure 1B:
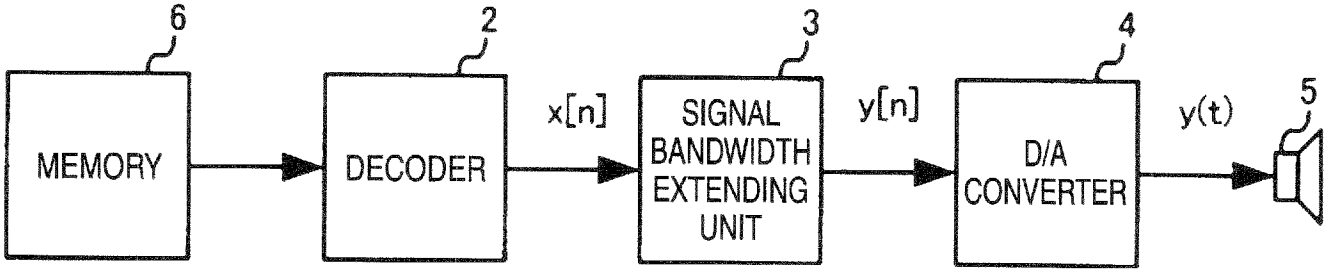

Further, in FIG. 1A, the invention is applied to the communication apparatus as an example. As shown in FIG. 1B, the invention may be applied to a digital audio player. The digital audio player is provided with a memory 6 using a flash memory or a hard disk drive (HDD) instead of the wireless communication unit 1. The decoder 2 decodes the music data read out from the memory 6 as described above.

Figure 2:
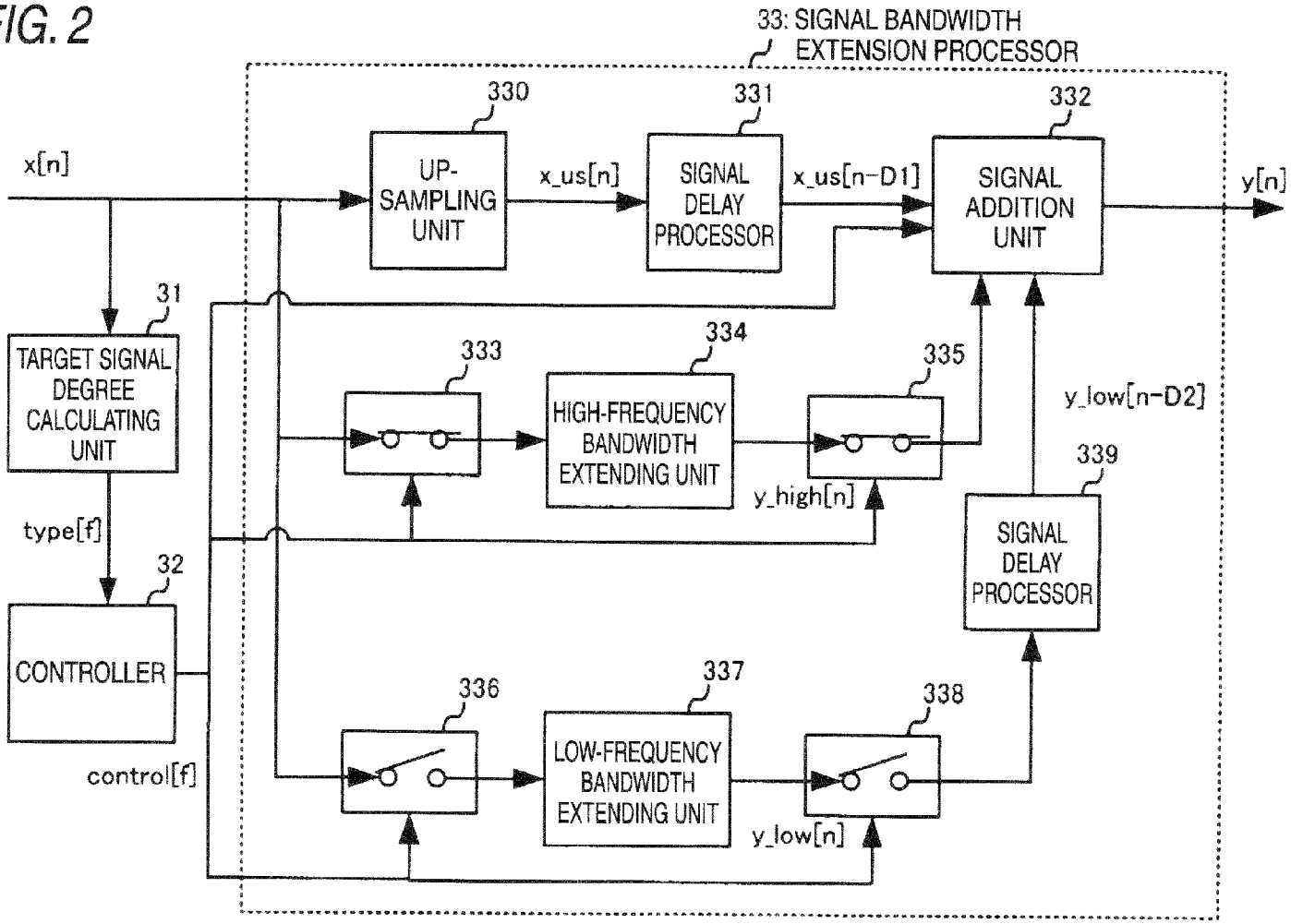
FIG. 2 is a circuit block diagram illustrating a configuration of a signal bandwidth extending unit.

Next, the signal bandwidth extending unit 3 will be described. FIG. 2 shows a configuration of the signal bandwidth extending unit 3 according to the embodiment. As shown in FIG. 2, the signal bandwidth extending unit 3 is provided with a target signal degree calculating unit 31, a controller 32, and a signal bandwidth extension processor 33. The signal bandwidth extension processor 33 is provided with an up-sampling unit 330, signal delay processors 331 and 339, a signal addition unit 332, switches 333, 335, 336, and 338, a high-frequency bandwidth extending unit 334, and a low-frequency bandwidth extending unit 337. These components may be implemented by one processor and software which is recorded in a storage medium (not shown).

Figure 3:
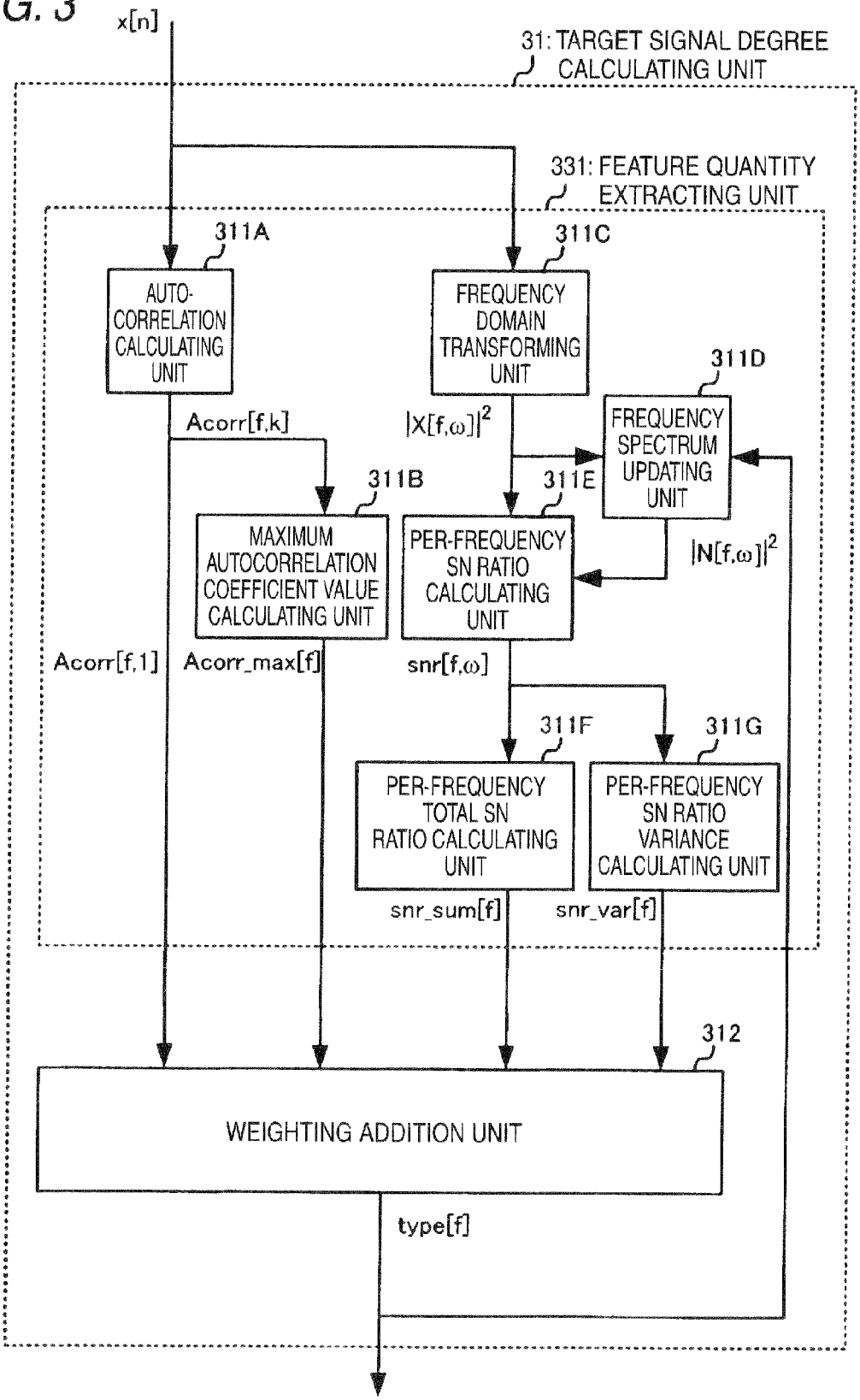
FIG. 3 is a circuit block diagram illustrating an exemplary configuration of a target signal degree calculating unit of a signal bandwidth extending unit shown in FIG. 2.

FIG. 3 shows an exemplary configuration of the target signal degree calculating unit 31. The target signal degree calculating unit 31 is provided with a feature quantity extracting unit 311 and a weighting addition unit 312. The feature quantity extracting unit 311 is provided with an autocorrelation calculating unit 311A, a maximum autocorrelation coefficient calculating unit 311B, a frequency domain transforming unit 311C, a frequency spectrum updating unit 311D, a per-frequency SN ratio calculating unit 311E, a per-frequency total SN ratio calculating unit 311F, and a per-frequency SN ratio variance calculating unit 311G.

The target signal degree calculating unit 31 calculates a target signal degree type[f] which is a target signal, which is to be extended, of the input signal x[n]. In this embodiment, the target signal to be extended is assumed to be a speech signal. In the input signal x[n], the speech signal which is the target signal and non-target signals (noise components, echo components reverberation components, music, etc.) other than the target signal are mixed with each other. That is, the target signal degree calculating unit 31 outputs the target signal degree type[f], which represents how much of the speech signals which are target signals are included in the input signal x[n] in each input frame. Here, the target signal degree type[f] may represent a ratio or a level of the target signal which is included in the input signal by using the SN ratio (signal to noise ratio), for example. In addition, the target signal degree type[f] may represent a degree of similarity between the signal characteristics of the input signal and the signal characteristics of the desired target signal by using an autocorrelation, for example.

In the following description, the speech or the speech signal is assumed to represent a sound spoken by a person. In addition, the music signal or the audio signal is assumed to represent a sound obtained by a musical instrument or by the singing voice of a person.

The feature quantity extracting unit 311 extracts plural feature quantities for outputting the target signal degree type [f] from the input signal x[n]. Here, as the plural feature quantities, the first autocorrelation coefficient Acorr[f, 1], a maximum autocorrelation coefficient Acorr_max[f], a per-frequency total SN ratio snr_sum[f], and a per-frequency SN ratio variance snr_var[f] will be described as examples. The feature quantity for calculating the target signal degree type [f] is not particularly limited as long as the feature quantity represents that how much of the speech signals are included in the input signal such as stationarity and periodicity of the speech signal in a short period of time, nonuniformity and roughness of power spectrums of the speech signal.

As shown in Expression 1, the autocorrelation calculating unit 311A calculates kth autocorrelation coefficient Acorr[f, k] (k=1, . . . , N−1) which is obtained such that the input signals are normalized by a power in frame units and then the normalized input signals are taken as absolute values, the resulting value is output to the maximum autocorrelation coefficient calculating unit 311B.

[Expression 1]

$$Acorr[f, k] = \left| \frac{\sum_{n=0}^{N-1-k} x[n] \cdot x[n+k]}{\sum_{n=0}^{N-1} x[n] \cdot x[n]} \right| \quad (1)$$

At the same time, the autocorrelation calculating unit 311A outputs the first autocorrelation coefficient Acorr[f, 1] with k=1 to the weighting addition unit 312. The value of the first autocorrelation coefficient Acorr[f, 1] is a value from 0 to 1. When the value is close to 0, the noises increase. That is, it is determined that, as the value of the first correlation coefficient Acorr[f, 1] becomes smaller, the non-target signal increases in the input signal, and the speech signal as the target signal decreases.

The maximum autocorrelation coefficient calculating unit 311B receives the kth autocorrelation coefficient Acorr[f, k] (k=1, . . . , N−1 which is the normalized value output from the autocorrelation calculating unit 311A, and outputs the autocorrelation coefficient Acorr[f, k], which is the maximum value among the kth autocorrelation coefficient Acorr[f, k] (k=1, . . . , N−1), as a maximum autocorrelation coefficient Acorr_max[f]. The maximum autocorrelation coefficient Acorr_max[f] is a value ranging from 0 to 1. Since having the stationarity and periodicity in a short time, the speech signal approximates "1". As the speech signal approximates "0", the input signal has a high possibility that it will have no correlativity and that it will be noise. That is, it is determined that, as the value of the maximum autocorrelation coefficient Acorr_max[f] becomes smaller, many non-target signals are included in the input signal, and the speech signal as the target signal decreases.

In the frequency domain transforming unit 311C, the input signals x[n] (n=0, 1, . . . , N−1) of the current frame f are input. Then, the input signals of the current frame are combined along a time direction with the samples in the input signal of the previous one frame (the previous one frame) which corresponds to the number of samples overlapped by windowing, and the input signals x[n] (n=0, 1, . . . , 2M−1), which correspond to an amount of the samples (2M) necessary for the frequency domain transformation, are extracted by properly performing zero padding or the like. The overlap which is the ratio of a data length of the current input signal to a shift width of the input signal in the previous one frame may be considered to be 50%. In this case, the number of samples, which overlap in the previous one frame and the current frame, is set so that L=48, and it is assumed that 2M=256 samples are prepared from the zero padding of the L samples of the input signal in the previous one frame, the N=160 samples of the input signal x[n] in the current frame, and the L samples. The signals of 2M samples are subjected to the windowing by multiplying a window function of the sine window. Then, the frequency domain transformation is performed on the signals of the 2M samples subjected to the windowing. The transformation to the frequency domain can be carried out by the Fast Fourier Transform (FFT) of which degree is set to 2M, for example. Further, by performing the zero padding on the signals to be subjected to the frequency domain transformation the data length is set to a higher power of 2 (2M), and the degree of the frequency domain transformation is set to a higher power of 2 (2M) but the degree of the frequency domain transformation is not limited thereto.

When the input signal x[n] is a real signal, the redundant M=128 bins are removed from the signal obtained by performing the frequency domain transformation, and thereby obtaining the frequency spectrum X[f, w] (w=0, 1, . . . , M−1). In this case, w represents the frequency bin. The frequency domain transforming unit 311C may output the frequency spectrum X[f, w] (w=0, 1, . . . , M−1), or may output the power spectrum $|X[f, w]|^2$ (w=0, 1, . . . , M−1), the amplitude spectrum |X[f, w]| (w=0, 1, . . . , M−1) or the phase spectrum $\theta_x[f, w]$ (w=0, 1, . . . , M−1). Here, it is assumed that the power spectrum $|X[f, w]|^2$ (w=0, 1, . . . , M−1) is output. Further, when the input signal x[n] is the real signal, the redundant one originally becomes the M−1=127 bins, the frequency bin w=128 of the highest frequency band should be taken into consideration. However, since the input signal x[n] is assumed to be a digital signal including the speech signal with limited bandwidth up to fs_nb_high=3950 [Hz], the speech quality is not adversely affected even though the frequency bin w=128 of the highest frequency band is not taken into consideration. To simplify the description below, the description is made without considering the frequency bin w=128 of the highest band. Of course, the frequency bin w=128 of the highest frequency band may also be taken into consideration. At this time, the frequency bin w=128 of the highest frequency band is equated to w=127 or treated independently.

The frequency domain transformation performed by the frequency domain transforming unit 311C is not limited to the FFT, but other orthogonal transformations for transforming to the frequency domain may as a substitute such as the Discrete Fourier Transform (DFT) or the Discrete Cosine Transform (DCT), the Modified DCT (MDCT), the Walsh Hadamard Transform (WHT), the Harr Transform (HT), the Slant Transform (SLT), and the Karhunen Loeve Transform (KIT). In addition, the window function used in the windowing is not limited to the sine window, but other symmetric windows (hann window, Blackman window, hamming window, etc.) or asymmetric windows which are used in a speech encoding process may be properly used.

The frequency spectrum updating unit 311D uses the target signal degree type[f] output from the weighting addition unit 312 and the power spectrum $|X[f,w]|^2$ (w=0, 1, . . . , M−1) of the input signal x[n] output from the frequency domain transforming unit 311C so as to estimate and output the power spectrum $|N[f,w]|^2$ of the non-target signal in each frequency band.

First, it is determined whether the input signal x[n] in each frame corresponds to a section (non-target signal section) in which the non-target signal is predominantly included or a section (target signal section) in which the speech signal as the target signal and the non-target signal exist together using the target signal degree type[f] which is output from the weighting addition unit 312. Hereinafter, the case where only the corresponding component exists or the case where the corresponding component is larger than other components is expressed as "being predominantly included".

The determination whether it is a non-target signal section or a target signal section is made such that, when the target signal degree type[f] is smaller than a threshold value predetermined in advance, it is determined that the input signal corresponds to the non-target signal section, and in the other case, it is determined that the input signal corresponds to the target signal section.

An average power spectrum is calculated from the power spectrum $|X[f,w]|^2$ of the frame in which it is determined that the non-target signal is predominantly included in the section (non-target signal section), and the average power spectrum is output as the power spectrum $|N[f,w]|^2$ (w=0, 1, . . . , M−1) of the non-target signal in each frequency band.

Specifically, as shown in Expression 2, the power spectrum $|N[f,w]|^2$ (w=0, 1, . . . , M−1) of the non-target signal in each frequency band is recurrently calculated using the power spectrum $|N[f-1,w]|^2$ of the non-target signal in each frequency band for the previous one frame. The forgetting coefficient $\alpha_N[\omega]$ in Expression 2 has a coefficient of 1 or less, for example, about 0.75 to 0.95.

[Expression 2]

$$|N[f,\omega]|^2=\alpha_N[\omega]\cdot|N[f-1,\omega]|^2+(1-\alpha_N[\omega])\cdot|X[f,\omega]|^2 \quad (2)$$

The per-frequency SN ratio calculating unit 311E receives the power spectrum $|X[f, w]|^2$ of the input signal output from the frequency domain transforming unit 311C and the power spectrum $|N[f, w]|^2$ of the non-target signal output from the frequency spectrum updating unit 311D. The per-frequency SN ratio calculating unit 311E calculates the SN ratio of each frequency band, which is the ratio of the power spectrum $|N[f, w]|^2$ of the non-target signal to the power spectrum $|X[f, w]|^2$ of the input signal. Here, the SN ratio snr[f, w] of each frequency band is calculated using Expression 3, and expressed in a dB scale.

[Expression 3]

$$snr[f, \omega] = 10\log_{10}\left(\frac{|X[f, \omega]|^2}{|N[f, \omega]|^2}\right) \tag{3}$$

The per-frequency total SN ratio calculating unit 311F receives the SN ratio snr[f, w] (w=0, 1, . . . , M−1) of each frequency band which is output from the per-frequency SN ratio calculating unit 311E. The per-frequency total SN ratio calculating unit 311F calculates the sum of the SN ratios snr[f, w] of the respective frequency bands using Expression 4, which is output as the per-frequency total SN ratio value snr_sum[f]. The per-frequency total SN ratio value snr_sum [f] takes a value of 0 or greater. As the value becomes smaller, it is determined that the non-target signal such as the noise component included in the input signal is large and the speech signal as the target signal decreases.

[Expression 4]

$$\text{snr_sum}[f] = \sum_{\omega=0}^{M-1} snr[f, \omega] \tag{4}$$

The per-frequency SN ratio variation calculating unit 311G receives the SN ratio snr[f, w] (w=0, 1, . . . , M−1) of each frequency band which is output from the per-frequency SN ratio calculating unit 311E. Then the per-frequency SN ratio variation calculating unit 311G calculates the variation of each frequency band using Expression 5, which is output as the per-frequency SN ratio variation value snr_var[f]. The per-frequency SN ratio variation value snr_var[f] is a value of 0 or greater. Since the power spectrum of the speech signal is not uniform but has roughness, the value increases. Therefore, as the value becomes smaller, it is determined that the non-target signal such as the noise component included in the input signal is large and the speech signal as the target signal decreases.

[Expression 5]

$$\text{snr_var}[f] = \sum_{\omega=0}^{M-1}\left|snr[f, \omega] - \frac{\sum_{i=0}^{M-1} snr[f, i]}{M}\right| \tag{5}$$

The weighting addition unit 312 uses the plural feature quantities extracted by the feature quantity extracting unit 311, such as the first autocorrelation coefficient Acorr[f, 1] output from the autocorrelation calculating unit 311C, the maximum autocorrelation coefficient Acorr_max[f] output from the maximum autocorrelation coefficient calculating unit 311D, the per-frequency total SN ratio value snr_sum[f] output from the per-frequency total SN ratio calculating unit 311F, and the per-frequency SN ratio variation value snr_var [f] output from the per-frequency SN ratio variation calculating unit 311G, to perform the weighting on the respective values with predetermined weight values, and thus the target signal degree type[f] is calculated which is the sum of the weight values of the plural feature quantities. Here, as the target signal degree type[f] becomes smaller, it is assumed that the non-target signal is predominantly included, and on the other hand, as the target signal degree type[f] becomes larger, the target signal is predominantly included. For example, the weighting addition unit 312 sets the weight values w1, w2, w3, and w4 (where, w1≥0, w2≥0, w3≥0, and w4≥0) to the values which are obtained by being previously learned in a learning algorithm which uses the determination of a linear discriminant function, and calculates the target signal degree type[f] as type[f]=w1·Acorr[f, 1]+w2·Acorr_max[f]+w3·snr_sum[f]+w4·snr_var[f]. Of course, the target signal degree type[f] is not limited to be expressed by the first linear sum of feature quantities, but may be expressed as the linear sum of the multiple degrees or the expression including multiplication terms of the plural feature quantities.

As described above, the frequency domain transforming unit 311C, the frequency spectrum updating unit 311D, the per-frequency SN ratio calculating unit 311E, the per-frequency total SN ratio calculating unit 311F, and the per-frequency SN ratio variation calculating unit 311G are described such that these perform processes on every frequency bin. However, the target signal degree type[f] may be calculated in group units such that groups are created by collecting the plural adjacent frequency bins which are obtained by the frequency domain transformation and then the processes are performed in group units. Further, the target signal degree type[f] may also be calculated in frame units such that the frequency domain transformation is implemented by a band division filter such as a filter bank, and then the processes are performed in bank units.

In addition, when the target signal degree calculating unit 31 calculates the target signal degree type[f], all the plurality of feature quantities mentioned above need not be used, or other feature quantities may be added and used. As other feature quantities, an average zero-crossing number Zi[f], an average value Vi[f] of an LPC spectral envelope, a frame power Ci[f], and the like may be used. Further, codec information may also be used, which is output from the wireless communication unit 1 or the decoder 2, for example a silence insertion descriptor (SID), voice detection information which represents whether the voice is from a voice activity detector (VAD) or not, or information which represents whether a pseudo background noise is generated or not. That is, the feature quantity for calculating the target signal degree type [f] is not particularly limited as long as it represents how many of the speech signals are included in the input signal by the degree of similarity between the input signal and the signal characteristics of the speech signal.

Figure 4:
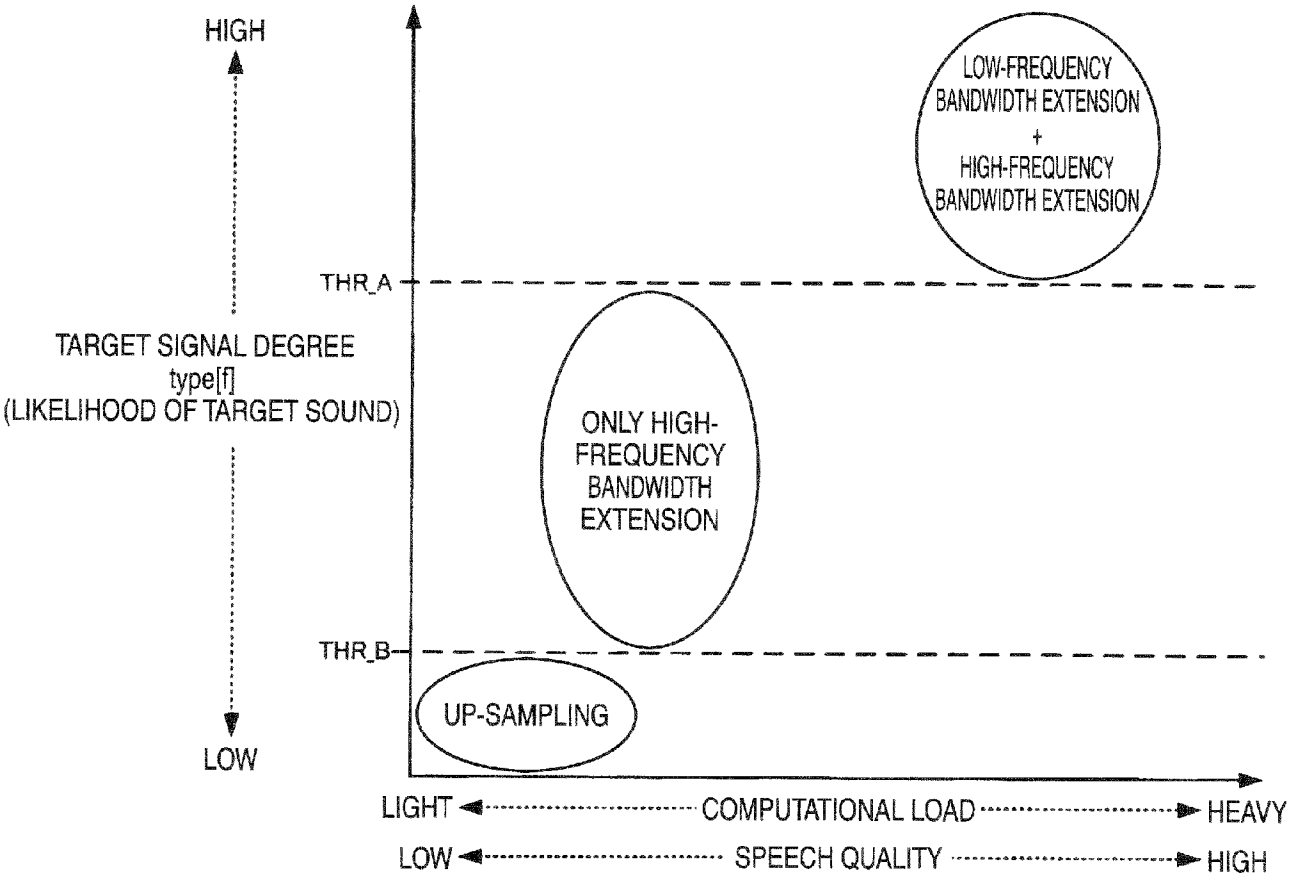
FIG. 4 is an exemplary view illustrating an operation of a controller of a signal bandwidth extending unit shown in FIG. 2.

The controller 32 receives the target signal degree type[f] which is output from the target signal degree calculating unit 31, and outputs a control signal control[f] which controls the high-frequency bandwidth extending unit 334 and the low-frequency bandwidth extending unit 337 so as to operate or not operate according to the target signal degree type[f]. FIG. 4 shows a control operation of the controller 32. As the degree of the target signal is lowered, the controller 32 performs control such that the bandwidth extension processing method is simply processed and is performed with a low speech quality. Further, as the degree of the target signal is raised, the controller 32 performs control such that the bandwidth extension processing method is performed with high accuracy and high speech quality. In addition, as the degree of the target signal is lowered, the controller 32 performs control such that the bandwidth extension processing method narrows the extending range of the frequency band. As the degree of the target signal is raised, the controller 32 performs control such that the bandwidth extension processing method widens the extending range of the frequency band. Furthermore, as the degree of the target signal is lowered, the controller 32 performs control such that the bandwidth extending process to the low-frequency band is not performed. As the degree of the target signal is raised the controller 32 performs control such that both the bandwidth extending process to the high-frequency band and the bandwidth extending process to the low-frequency band are performed.

In general, as the bandwidth extension processing method is performed with lower speech quality, the process is simplified. Therefore, the process is performed with a light computational load. As the bandwidth extension processing method is performed with higher speech quality the process is performed with higher accuracy. Therefore, the process is performed with a heavy computational load. As a result, the target signal is subjected to the bandwidth extending process with high accuracy, and thus high speech quality can be maintained. Since the non-target signal does not need to be subjected to the bandwidth extending process with high accuracy, the simple bandwidth extending process is preformed, so that the computational load can be reduced.

Specifically, the controller 32 compares the target signal degree type[f] with predetermined threshold values THR_A and THR_B. When the target signal degree type[f] is equal to or more than THR_A, the control signal control[f] is set to 2 and controls the high-frequency bandwidth extending unit 334 and the low-frequency bandwidth extending unit 337 to operate together. When the target signal degree type[f] is less than THR_A and equal to or more than THR_B, the control signal control[f] is set 1 and controls the high-frequency bandwidth extending unit 334 so as to operate and the low-frequency bandwidth extending unit 337 so as not to operate. When the target signal degree type[f] is less than THR_B, the control signal control[f] is set to 0 and controls the high-frequency bandwidth extending unit 334 and the low-frequency bandwidth extending unit 337 not to operate together. When receiving the control signal control[f]=2, the signal bandwidth extension processor 33 closes the switch 333, the switch 335, the switch 336, and the switch 338, and thus causes the high-frequency bandwidth extending unit 334 and the low-frequency bandwidth extending unit 337 to operate together. On the other hand, when receiving the control signal control[f]=2 the signal bandwidth extension processor 33 closes the switch 333 and the switch 335, and thus causes the high-frequency bandwidth extending unit 334 to operate, and opens the switch 336 and the switch 338 and thus causes the low-frequency bandwidth extending unit 337 not to operate. In addition, when receiving the control signal control[f]=0 the signal bandwidth extension processor 33 opens the switch 333, the switch 335, the switch 336, and the switch 338, and thus causes the high-frequency bandwidth extending unit 334 and the low-frequency bandwidth extending unit 337 not to operate together.

Further, the controller 32 may perform control such that the control signal control[f] does not change frequently. Since the target signal degree typed[f] is calculated in frame units the control signal control[f] is frequently switched when there is instantly no sound or no voiced sound within one conversation. Therefore, the processing method of the bandwidth extension is frequently changed, and thus an abnormal sound may occur. Accordingly, by performing the following processes, it is possible to suppress the control signal control[f] from being frequently switched in frame units within one conversation.

First, as information which allows the switching, variables sum_flag[f] and sum_flag[f] are calculated which are accumulated and added in every frame as described in the following. In this case, sum_flag[0]=0 and sum_flag2[0]=0, and the values thereof are set to 0 when starting the operation of the signal bandwidth extending unit 3. In addition, control_tmp [f]=control[f], and the control signal control[f] is stored. When control_tmp[f]=1 or control_tmp[f]=2, sum_flag[f] is set to sum_flag[f]+1, so that control[f]=1 or control[f]=2 is easy to be maintained or control[f]=0 is easy to be updated. On the other hand, when control_tmp[f]=0, sum_flag[f] is set to sum_flag[f]−1, so that control[f]=1 or control[f]=2 is easy to be updated or control[f]=0 is easy to maintain. In a similar manner, when control_tmp[f]=2, sum_flag2[f] is set to sum_flag2[f]+1, and when control_tmp[f]−0 or control_tmp[f]=1 sum_flag2[f] is set to sum_flag2[f]−1.

Next, in order to quickly detect the beginning of a word, when sum_flag[f]<−3, sum_flag[f] is set to −3, the lower limit of sum_flag[f] is controlled. In a similar manner, when sum_flag2[f]<−3 sum_flag2[f] is set to −3.

Then, in order not to be frequently switched in frame units, the control signal control[f] is updated by prioritizing in the order of the following determination conditions (1) to (4) using the variables sum_flag[f] and sum_flag2[f]. Further, the lower the number is, the higher the priority is, and when the conditions overlap, the process in the condition with the higher priority is performed.

(1) When control_tmp[f]=1 and sum_flag2[f]>0, control[f] is updated to 2.

(2) When control_tmp[f]=2 and sum_flag2[f]<0, control[f] is updated to 1.

(3) When control_tmp[f]=0 and sum_flag[f]>0, control[f] is updated to 1.

(4) When control_tmp[f]=1 and sum_flag[f]<0, control[f] is updated to 0.

(5) In other cases, the control signal control[f] is set to control_tmp[f] and the control signal control[f] is maintained.

As a result, the control signal control[f] cannot be frequently switched in frame units within one conversation. In addition, without frequently updating the processing method of the bandwidth extension, it is possible to always maintain the natural speech quality.

In addition, as another method of controlling the control signal control[f] so as not to be frequently switched in frame units within one conversation, there is a method in which different threshold values are used in the case of switching control[f] from 0 to 1 and in the case of switching control[f] from 1 to 0. Alternatively, control[f] may be controlled to obtain the same result of the control signal control[f] such that the control signal control[f] is forcibly intermittent during a predetermined time so as not to be frequently switched.

The signal bandwidth extension processor 33 extends the bandwidth of the input signal x[n] to obtain a wideband signal y[n] as an output signal. At this time, the process of the bandwidth extension is changed according to the control signal control[f] which is output from the controller 32.

The high-frequency bandwidth extending unit 334 is controlled so as to operate or not operate according to the control signal control[f] which is output from the controller 32. The high-frequency bandwidth extending unit 334 operates to close the switch 333 when the control signal control[f] is set to 1 or 2. When operating the high-frequency bandwidth extending unit 334 performs a high-frequency bandwidth extending process on the input signal x[n] to extend a frequency band higher than the frequency band of the input signal x[n], and thus generates a high-frequency wideband signal y_high[n]. Then, the switch 335 is closed to output the high-frequency wideband signal y_high[n]. On the other hand since the switch 333 is opened when the control signal control[f] is set to 0, the high-frequency bandwidth extending unit 334 does not operate. Then, as the switch 335 is opened, the high-frequency wideband signal y_high[n] is not to output.

Figure 5:
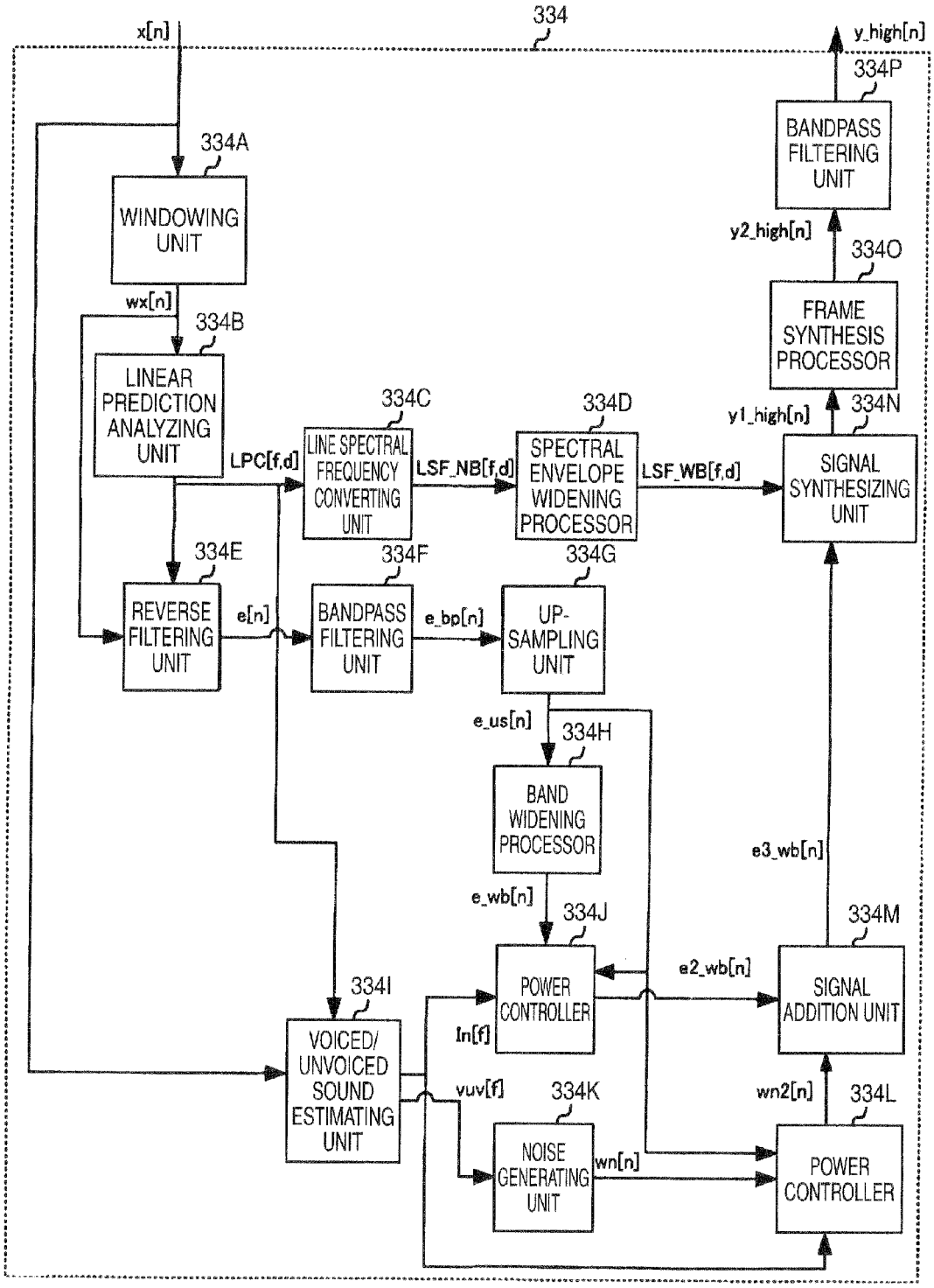
FIG. 5 is a circuit block diagram illustrating an exemplary configuration of a high-frequency bandwidth extending unit of a signal bandwidth extending unit shown in FIG. 2.

The high-frequency bandwidth extending unit 334 is configured as shown in FIG. 5, for example. The high-frequency bandwidth extending unit 334 is provided with a windowing unit 334A, a linear prediction analyzing unit 334B, a line spectral frequency converting unit 334C, a spectral envelope widening processor 334D, a reverse filtering unit 334E, a bandpass filtering unit 334F, an up-sampling unit 334G, a band widening processor 334H, a voiced/unvoiced sound estimating unit 334I, a power controller 334J, a noise generating unit 334K, a power controller 334L, a signal addition unit 334M, a signal synthesizing unit 334N, a frame synthesis processor 334O, and a bandpass filtering unit 334P.

The windowing unit 334A receives the input signal x[n] (n=0, 1, . . . , N−1) of the current frame f which is limited in a narrowband and prepares the input signal x[n] (n=0, 1, . . . , 2N−1) which is a total of 2N in data length by combining two frames of the input signals from the current frame and the previous one frame, performs the windowing of 2N in data length on the input signal x[n] (n=0, 1, . . . , 2N−1) by multiplying the input signal x[n] by a window function which is the Hamming window, and outputs the input signal wx[n] (n=0, 1, . . . , 2N−1) obtained by the windowing. Further, the input signal x[n] in the previous one frame is kept using memory provided at the windowing unit 334A. Here, for example, the overlap which is the ratio of the data length (here, which corresponds to 2N samples) of the windowed input signal wx[n] to the shift width (here, which corresponds to N samples) of the input signal x[n] in the next time (frame) is 50%. In this case, the window function used in the windowing is not limited to the hamming window, but other symmetric windows (hann window, Blackman window, sine windows, etc.) or asymmetric windows which are used in speech encoding processes may be properly used. In addition, the overlap is not limited to 50%.

The linear prediction analyzing unit 334B receives the windowed input signal wx[n] (n=0, 1, . . . , 2N−1) which is output from the windowing unit 334A, performs a Dnb-th linear prediction analysis on the input signal, and obtains a Dnb-th linear prediction coefficient LPC[f, d] (d=1, . . . , Dnb). Here, Dnb is assumed to be 10, for example.

The line spectral frequency converting unit 334C converts the linear prediction coefficient LPC[f, d] (d=1, . . . , Dnb) obtained by the linear prediction analyzing unit 334B into a same degree line spectral frequency (LSF), obtains a line spectral frequency LSF_NB[f, d] (d=1, . . . , Dnb) which is a narrowband spectral parameter representing the spectral envelope in a narrowband, and outputs the line spectral frequency to the spectral envelope widening processor 334D. In this embodiment, the case where the line spectral frequency is used as the narrowband spectral parameter which represents the narrowband spectral envelope is described as an example. However, as the narrowband spectral parameter, the linear prediction coefficient (LPC) or the line spectrum pairs (LSP) the PARCOR coefficient or the reflection coefficient, the cepstral coefficient, the mel frequency cepstral coefficient, or the like may be used.

The spectral envelope widening processor 334D prepares in advance the correspondence between the narrowband spectral parameter representing the spectral envelope of the narrowband signal and the wideband spectral parameter representing the spectral envelope of the wideband signal through modeling, and obtains the narrowband spectral parameter (here, which corresponds to the line spectral frequency LSF_NB[f, d]). The spectral envelope widening processor 334D uses the spectral parameter to perform a process of obtaining the wideband spectral parameter (here, which corresponds to the line spectral frequency LSF_WB[f, d]) from the correspondence between the narrowband spectral parameter and the wideband spectral parameter which is prepared in advance through modeling. As a scheme for converting the spectral parameter representing the narrowband spectral envelope to the spectral parameter representing the wideband spectral envelop there are a scheme using a codebook by vector quantization (VQ) (for example, Yoshida, Abe, "Generation of Wideband Speech from Narrowband Speech by Codebook Mapping", (D-II), vol. J78-D-II, No. 3, pp. 391-399, March 1995), a scheme using GMM (for example, K. Y. Park, H. S. Kim, "Narrowband to Wideband Conversion of Speech using GMM based Transformation", Proc. ICASSP2000, vol. 3, pp. 1843-1846, June 2000), a scheme using a code book by vector quantization and HMM (for example, G. Chen, V. Parsa, "HMM-based Frequency Bandwidth Extension for Speech Enhancement using Line Spectral Frequencies", Proc. ICASSP2004, vol. 1, pp. 709-712, 2004), and a scheme using HMM (for example, S. Yao, C. F. Chan, "Block-based Bandwidth Extension of Narrowband Speech Signal by using CDHMM", Proc. ICASSP20005, vol. 1, pp. 793-796, 2005). Any one of the above schemes may be used. Here, the scheme using Gaussian Mixture Model (GMM) described above is employed, and the line spectral frequency LSF_NB[f, d] which is the narrowband spectral parameter obtained by the line spectral frequency converting unit 334C is converted into the Dwb-th wideband line spectral frequency LSF_WB[f, d] (d=1, . . . , Dwb) which is a second wideband spectral parameter corresponding to a range from fs_wb_low [Hz] to fs_wb_high [Hz] using GMM which is prepared in advance through modeling of the correspondence between the line spectral frequency LSF_NB[f, d] and the line spectral frequency LSF_WB[f, d]. Here, Dwb is assumed to be 18, for example. Further, the feature quantity data which is the wideband spectral parameter and represents the spectral envelope is not limited to the line spectral frequency but may be the linear prediction coefficient LPC, the PARCOR coefficient or the reflection coefficient, the cepstral coefficient, the mel frequency cepstral coefficient, or the like.

The reverse filtering unit 334E forms a reverse filter using the linear prediction coefficient LPC[f, d] output from the linear prediction analyzing unit 334B, inputs the windowed input signal wx[n] of 2N in data length output from the windowing unit 334A to the reverse filter, and outputs the linear prediction residual signal e[n] of 2N in data length which is the narrowband sound source signal.

The bandpass filtering unit 334F is a filter for making the linear prediction residual signal e[n] which is output from the reverse filtering unit 334E pass through the frequency band used in widening the passband. In addition the bandpass filtering unit 334F has at least the characteristics of reducing the low-frequency band. Here, it is assumed that the bandpass filtering unit makes the input signal pass through a band ranging from 1000 [Hz] to 3400 [Hz]. Specifically, the bandpass filtering unit receives the linear prediction residual signal e[n] of 2N in data length which is obtained by the reverse filtering unit 334E, performs band pass filtering, and outputs the linear prediction residual signal e_bp[n] subjected to the bandpass filtering to the up-sampling unit 334G.

The up-sampling unit 334G performs the same process as that of the up-sampling unit 330. The up-sampling unit 334G up-samples the signal e_bp[n], which is output from the bandpass filtering unit 334F, from the sampling frequency fs [Hz] to fs' [Hz], removes the aliasing and outputs the signal e_us[n] of 4N in data length.

The band widening processor 334H performs a non-linear process on the up-sampled linear prediction residual signal e_us[n] of 4N in data length, which is obtained by the up-sampling unit 334G, and thus converts the linear prediction residual signal into the wideband signal of which at least the voiced sound has a structure (a harmonic structure) in which the signal has a peaks value in frequency domain for every harmonic of the fundamental frequency. As a result, the widened linear prediction residual signal e_wb[n] of 4N in data length is obtained.

Figure 6A:
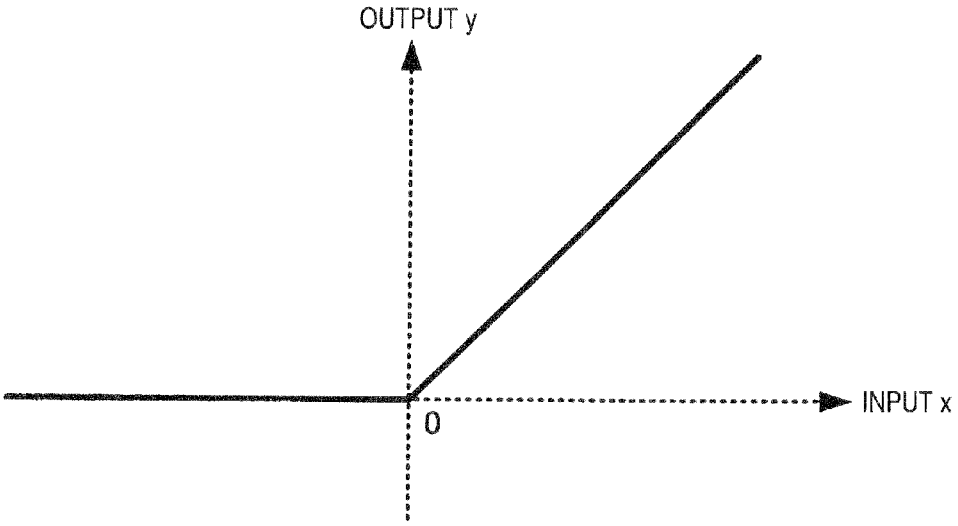
FIGS. 6A and 6B are views illustrating examples of non-linear functions used in a nonlinear process of a band widening processor of a high-frequency bandwidth extending unit of a signal bandwidth extending unit shown in FIG. 5.
Figure 6B:
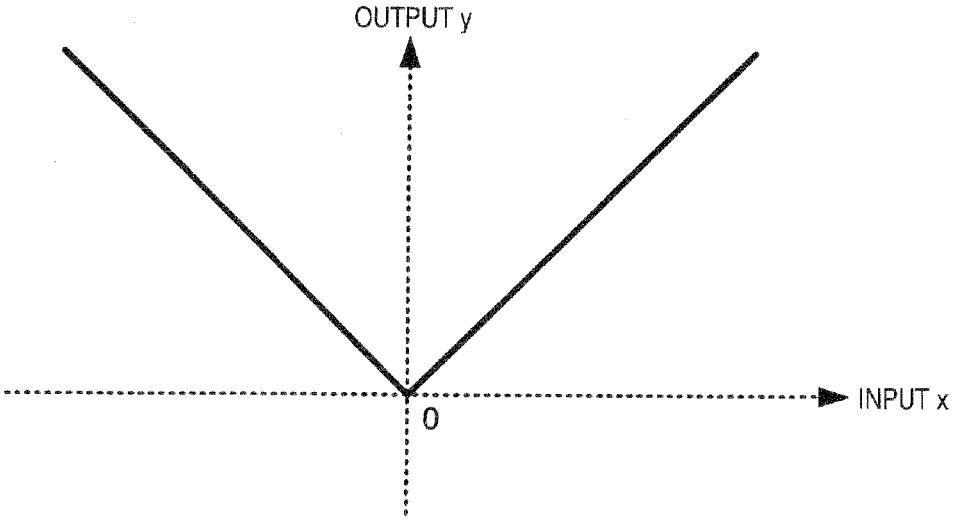

As an example of the non-linear process of conversion to the harmonic structure, there is a non-linear process using a non-linear function as shown in FIGS. 6A and 6B. FIG. 6A shows the half-wave rectification. In addition, the non-linear process of conversion to the harmonic structure may use the full-wave rectification as shown in FIG. 6B. The non-linear process is not limited to these processes. However, it is preferable that the input signal limited in the bandwidth be a function with at least periodicity. This is because, when the fundamental frequency of the input signal is missing in the voiced sound due to the bandwidth limitation the fundamental frequency is generated, and when the fundamental frequency of the input signal is not missing the fundamental frequency is not generated.

The voiced/unvoiced sound estimating unit 334I receives the input signal x[n] and the Dn-th linear prediction coefficient LPC[f, d] which is the narrowband spectral parameter subjected to the linear prediction analysis by the linear prediction analyzing unit 334B. Then, the voiced/unvoiced sound estimating unit 334I estimates whether the input signal x[n] is "voiced sound" or "unvoiced sound" in frame units, and outputs estimation information vuv[f]. Specifically, the voiced/unvoiced sound estimating unit 334I first calculates the number of zero crosses from the input signal x[n] in frame units, and divides the calculated value by the frame length N to take an average, and then the averaged value is taken as a negative number to calculate the negative average zero-crossing number Zi[f]. Next, as shown in Expression 6, the square sum of the input signal x[n] in frame units is calculated in dB units, and the resulting value is output as the frame power Ci[f].

[Expression 6]

$$Ci[f] = 10\log_{10}\left(\sum_{n=0}^{N-1} x[n]\cdot x[n]\right) \tag{6}$$

In addition, as shown in Expression 7, the first autocorrelation coefficient In[f] is calculated in frame units. Further, In[f] may be employed as the first autocorrelation coefficient Acorr[f, 1] normalized by the power which is output from the autocorrelation calculating unit 311A of the above-mentioned target signal degree calculating unit 31.

[Expression 7]

$$\mathrm{In}[f] = \frac{\sum_{n=0}^{N-1-1} x[n]\cdot x[n+1]}{\sum_{n=0}^{N-1} x[n]\cdot x[n]} \tag{7}$$

Then, zero padding is performed on the Dn-th linear prediction coefficient LPC[F, d] which is the narrowband spectral parameter to generate the signal of which the data length is M, which is a higher power of 2, and the FFT is performed in which the degree is set to M. For example, M is set to 256. Here, w represents the number of the frequency bin, which ranges from 0 to M−1 (0≤w≤M−1). As a result of the FFT, the frequency spectrum L[f, w] is obtained, the power spectrum |L[f, w]↑2 obtained by squaring the frequency spectrum L[f, w] is written as a logarithm using a base of 10, and is increased by −10 times, so that the spectral envelope by the LPC is calculated in dB units. Then, the average value Vi[f] of the spectral envelope by the LPC in the band in which the fundamental frequency is assumed to exist is calculated as shown in Expression 8. Further, for example the band in which the fundamental frequency is assumed to exist is set to 75 [Hz]≤fs·w/256 [Hz]≤325 [Hz], that is, the average of 2≤w≤11 is calculated as Vi[f].

[Expression 8]

$$Vi[f] = \frac{1}{10}\sum_{\omega=2}^{11} -10\log_{10}(|L[f,\omega]|^2) \tag{8}$$

Then, the voiced/unvoiced sound estimating unit 334I monitors the value for every frame, the value is calculated by multiplying the frame power Ci[f] to the linear sum of the negative average zero-crossing number Zi[f], the first autocorrelation coefficient In[f] and the average value Vi[f] of the LPC spectral envelope which are each weighted with a proper weight values. When the value exceeds a predetermined threshold value, the voiced/unvoiced sound estimating unit 334I estimates the input signal as "voiced sound". When the value does not exceed the predetermined threshold value, the voiced/unvoiced sound estimating unit 334I estimates the input signal as "unvoiced sound". Then, the voiced/unvoiced sound estimating unit 334I outputs the estimation information vuv[f].

The power controller 334J amplifies the widened signal e_wb[n] of 4N in data length, which is obtained by the band widening processor 334H, up to a predetermined level on the basis of the signal e_us[n] of 4N in data length which is output from the up-sampling unit 334G and the first autocorrelation coefficient In[f] which is output from the voiced/unvoiced sound estimating unit 334I. Then, the power controller 334J outputs the amplified signal e2_wb[n] to the signal addition processor 334M. Specifically, the power controller 334J first calculates the square sum of the signal e_us[n] of 4N in data length, calculates the square sum of the signal e_wn[n] of 4N in data length, and calculates the amplification gain g1[f] by dividing the square sum of the signal e_us[n] by the square sum of the signal e_wb[n]. Next, in order to further amplify the level when the input signal is voiced sound, an amplification gain g2[f] is calculated which approaches a value of 1 when the absolute value of the first autocorrelation coefficient In[f] approaches a value of 1 and approaches a value of 0 when the absolute value of the first autocorrelation coefficient In[f] approaches a value of 0. Then, the power control is performed by multiplying the signal e_wb[n] by the amplification gains g1[f] and g2[f].

When the estimation information vuv[f] corresponds to "unvoiced sound" as the estimation result of the voiced/unvoiced sound estimating unit 334I, the noise generating unit 334K uniformly generates random numbers. By using the random numbers for amplitude values of the signal, a white noise signal wn[n] of 4N in data length is generated and output.

The power controller 334L amplifies the noise signal wn[n], which is generated by the noise generating unit 334K, up to a predetermined level on the basis of the signal e_us[n] of 4N in data length output from the up-sampling unit 334G and the first autocorrelation coefficient In[f] output from the voiced/unvoiced sound estimating unit 334I. Then, the power controller 334L outputs the amplified signal wn2[n] to the signal addition processor 334M. Specifically, the power controller 334L first calculates the square sum of the signal e_us[n] of 4N in data length, calculates the square sum of the noise signal wn[n] of 4N in data length, and calculates the amplification gain g3[f] by dividing the square sum of the signal e_us[n] by the square sum of the noise signal wn[n]. Next, in order to further amplify the level when the input signal is the unvoiced sound, an amplification gain g4[f] is calculated which approaches a value of 1 when the absolute value of the first autocorrelation coefficient In[f] approaches a value of 0 and approaches a value of 0 when the absolute value of the first autocorrelation coefficient In[f] approaches a value of 1. Then, the power control is performed by multiplying the noise signal wn[n] by the amplification gains g3[f] and g4[f], and then the signal wn2[n] is output.

The signal addition processor 334M adds the noise signal wn2[n] output from the power controller 334L and the signal e2_wb[n] output from the power controller 334J, and outputs the signal e3_wb[n] of 4N in data length as the wideband sound source signal to the signal synthesizing unit 334N.

The signal synthesizing unit 334N generates the line spectrum pair LSP_WB[f, d] (d=1, . . . , Dwb) on the basis of the line spectral frequency LSF_WB[f, d] (d=1, . . . , Dwb) which is obtained by the spectral envelope widening processor 334D and is the wideband spectral parameter. The signal synthesizing unit 334N performs an LSP synthesis filter process on the linear prediction residual signal e3_wb[n] of 4N in data length which is obtained by the signal addition processor 334M and is the wideband sound source signal and calculates the wideband signal y1_high[n] of 4N in data length.

The frame synthesis processor 334O performs the frame synthesis in order to return the amount of the overlapped portion in the windowing unit 334A, and outputs the wideband signal y2_high[n] of 2N in data length. Specifically, since the overlap is set to 50% in this case, the y2_high[n] of 2N in data length is calculated by adding the temporal first half data (which has the data length of 2N) of the wideband signal y1_high[n] of 4N in data length and the temporal second half data (which has the data length of 2N) of the wideband signal y1_high[n] of 4N in data length which is output by the signal synthesizing unit 334N in the previous one frame.

The bandpass filtering unit 334P performs a filtering process, in which only the widen frequency band is passed, on the wideband signal y2_high[n] of 2N in data length which is output from the frame synthesis processor 334O. The bandpass filtering unit 334P outputs the passed signal, that is, the widen frequency band signal as a high-frequency wideband signal y_high[n] of 2N in data length. That is, by the filtering process described above, the signal corresponding to the frequency bandwidth from fs_nb_high [Hz] to fs_wb_high [Hz] is passed, and the signal in this frequency band is obtained as the high wideband signal y_high[n].

The low-frequency bandwidth extending unit 337 is controlled so as to operate or not operate according to the control signal control[f] which is output from the controller 32. When the control signal control[q] is set to 2, the switch 336 is closed and thus the low-frequency bandwidth extending unit 337 operates. When operating, the low-frequency bandwidth extending unit 337 performs a low-frequency bandwidth extending process on the input signal x[n], and thus generates the low wideband signal y_low[n] which is obtained by extending the frequency band lower than the frequency band of the input signal x[n]. When the switch 338 is closed, the low-frequency bandwidth extending unit 337 outputs the low wideband signal y_low[n].

On the other hand, when the control signal control[f] is set to 0 or 1, the switch 336 is opened. Therefore, the low-frequency bandwidth extending unit 337 does not operate. The switch 338 is opened, and thus the low wideband signal y_low[n] is not output.

Figure 7:
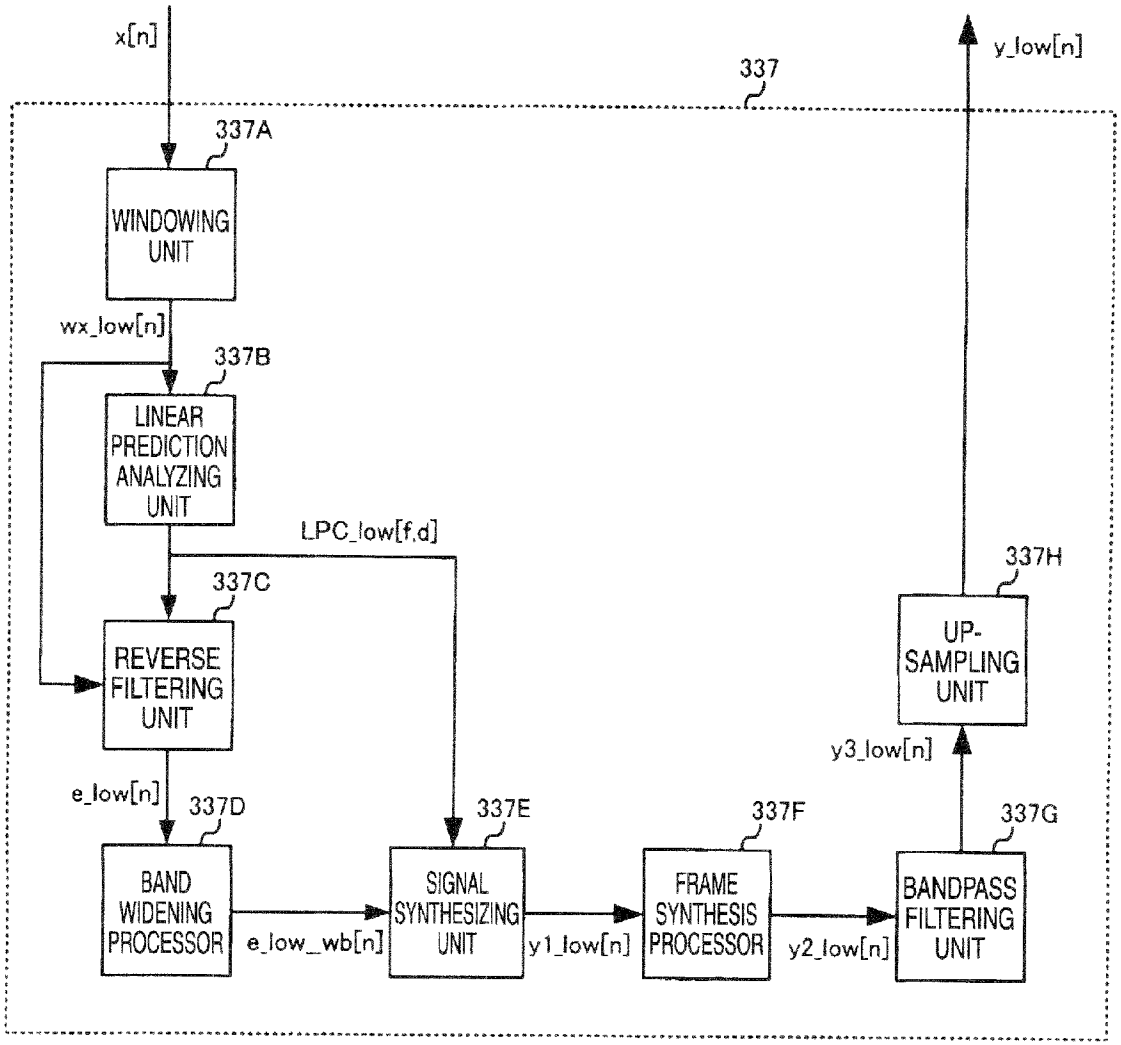
FIG. 7 is a circuit block diagram illustrating an exemplary configuration of a low-frequency bandwidth extending unit of a signal bandwidth extending unit shown in FIG. 2.

The low-frequency bandwidth extending unit 337 is configured as shown in FIG. 7, for example. The low-frequency bandwidth extending unit 337 is provided with a windowing unit 337A, a linear prediction analyzing unit 337B, a reverse filtering unit 337C, a band widening processor 337D, a signal synthesizing unit 337E, a frame synthesis processor 337F, a bandpass filtering unit 337G, and an up-sampling unit 337H.

The windowing unit 337A performs the same process as that of the windowing unit 334A. The windowing unit 337A receives the input signal x[n] (n=0, 1, . . . , N−1) of the current frame f which is limited in a narrowband, and prepares the input signal x[n] (n=0, 1, . . . , N−1) which is a total of 2N in data length by combining two frames of the input signals from the current frame and the previous one frame, performs the windowing of 2N in data length on the input signal x[n] (n=0, 1, . . . , N−1) by multiplying the input signal by a window function, and outputs the input signal wx_low[n] (n=0, 1, . . . , 2N−1) obtained by the windowing. Of course, the windowing unit 337A may commonly process together with the windowing unit 334A by setting wx_low[n] to wx[n] (n=0, 1, . . . , 2N−1).

The linear prediction analyzing unit 337B performs the same process as that of the linear prediction analyzing unit 334B. The linear prediction analyzing unit 337B receives the input signal wx_low[n] (n=0, 1, . . . , 2N−1) which is output from the windowing unit 337A and is subjected to the windowing, performs a linear prediction analysis on the input signal, and obtains the Dn-th linear prediction coefficient LPC_low[f, d] (d=1, . . . , Dn) as the second narrowband spectral parameter. Here, Dn is set to 14, for example. Of course, Dn is set to Dnb and LPC_low[f, d] is set to LPC[f, d], and the narrowband spectral parameter is set to be equal to the second narrow spectral parameter, so that the linear prediction analyzing unit 337*b* may be processed in the same way as the linear prediction analyzing unit 334B.

The reverse filtering unit 337C performs the same process as that of the reverse filtering unit 334E. The reverse filtering unit 337C forms a reverse filter using the linear prediction coefficient LPC_low[f, d] which is obtained by the linear prediction analyzing unit 337B and is the second narrowband spectral parameter, inputs the input signal wx[n] of 2N in data length, which is windowed by the windowing unit 337A, to the reverse filter, and obtains the linear prediction residual signal e_low[n] of 2N in data length as a second narrowband sound source signal. Of course, Dn is set to Dnb and LPC_low

[f, d] is set to LPC[f, d], so that the reverse filtering unit 337C may be processed in the same way as the reverse filtering unit 334E.

The band widening processor 337D performs the same process as that of the band widening processor 334H. The band widening processor 337D performs a non-linear process on the signal e_low[n] of 2N in data length, which is output from the reverse filtering unit 337D, and thus converts the signal into the wideband signal of which at least the voiced sound has a structure (a harmonic structure) in which the signal has a peak value in frequency domain for every harmonic of the fundamental frequency. As a result, the widened linear prediction residual signal e_low_wb[n] of 2N in data length is obtained.

The signal synthesizing unit 337E receives the linear prediction coefficient LPC_low[f, d] which is the narrowband spectral parameter and the linear prediction residual signal e_low_wb[n] of 2N in data length. The signal synthesizing unit 337E generates the linear prediction synthesizing filter using the linear prediction coefficient LPC_low[f, d], performs the linear prediction synthesis on the linear prediction residual signal e_low_wb[n] of 2N in data length, and thus generates the wideband signal y1_low[n] of 2N in data length.

The frame synthesis processor 337F performs the same process as that of the frame synthesis processor 334O. The frame synthesis processor 337F performs the frame synthesis in order to return the amount of the overlapped portion in the windowing unit 337A, and outputs the wideband signal y2_low[n] of N in data length. Specifically, since the overlap is set to 50% in this case, the y2_low[n] of N in data length is calculated by adding the temporal first half data (which has the data length of N) of the wideband signal y1_low[n] of 2N in data length and the temporal second half data (which has the data length of N) of the wideband signal y1_low[n] of 2N in data length which is output by the signal synthesizing unit 337E in the previous one frame.

The bandpass filtering unit 337G performs a filtering process in which only the frequency band to be widened is passed, on the wideband signal y2_low[n] of N in data length which is output from the frame synthesis processor 337F. The bandpass filtering unit 337G outputs the passed signal, that is the frequency band signal to be widened as a high-frequency wideband signal y3_low[n] of N in data length That is, by the bandpass filtering process described above, the signal corresponding to the frequency bandwidth from fs_wb_low [Hz] to fs_nb_low [Hz] is passed, and the signal in this frequency band is obtained as the wideband signal y3_low[n].

The up-sampling unit 337H up-samples the signal y3_low [n] of N in data length, which is output from the bandpass filtering unit 337G, from the sampling frequency fs [Hz] to fs' [Hz], removes the aliasing, and outputs the low-frequency wideband signal y_low[n] of 2N in data length.

The up-sampling unit 330 performs the same process as that of the up-sampling unit 334G. The up-sampling unit 330 up-samples the input signal x[n] of N in data length from the sampling frequency fs [Hz] to fs' [Hz], removes the aliasing, and outputs the x_us[n] of 2N in data length.

The signal delay processor 331 delays the up-sampled input signal x_us[n] of 2N in data length which is output from the up-sampling unit 330, by buffering for only a predetermined time (D1 samples) and outputs x_us[n−D1]. Therefore, the signal delay processor 331 is synchronized with the signal y_high[n] which is output from the high-frequency bandwidth extending unit 334 by matching the timing with each other. That is, the predetermined time (D1 samples) corresponds to the value (D1=D_high−D_us) which is obtained by subtracting the process delay time D_us, which is the time taken from the input to the output in the up-sampling unit 330, from the process delay time D_high which is the time taken from the input to the output in the high-frequency widebandwidth extending unit 334. The value is calculated in advance, and D1 is always used as a fixed value.

The signal delay processor 339 delays the wideband signal y_low[n] of 2N in data length, which is output from the low-frequency bandwidth extending unit 337, by buffering for only a predetermined time (D2 samples) and outputs y_low[n−D2]. Therefore, the signal delay processor 339 is synchronized with the signal y_high[n] which is output from the high-frequency bandwidth extending unit 334 by matching the timing with each other. That is, the predetermined time (D2 samples) corresponds to the value (D2=D_high−D_low) which is obtained by subtracting the process delay time D_low, which is the time taken from the input to the output in the low-frequency bandwidth extending unit 337, from the process delay time D_high which is the time taken from the input to the output in the high-frequency bandwidth extending unit 334. The value is calculated in advance, and D2 is always used as a fixed value. In this case, the signal delay processor 339 operates only when the control signal control [f] is set to 2 and the low-frequency wideband signal y_low[n] is output by the operation of the low-frequency bandwidth extending unit 337.

When the control signal control[f] is set to 2, the signal addition unit 332 adds the input signal x_us[n−D1] of 2N in data length, which is output from the signal delay processor 331, the wideband signal y_low[n−D2] of 2N in data length, which is output from the signal delay processor 339, and the wideband signal y_high[n] of 2N in data length, which is output from the high-frequency bandwidth extending unit 334, in the sampling frequency fs' [Hz], and obtains the wideband signal y[n] of 2N in data length as the output signal. As a result, the up-sampled input signal x[n−D1] is extended to a wideband by the wideband signal y_high[n] and the wideband signal y_low[n], so that a signal extended to the bandwidth from fs_wb_low [Hz] to fs_wb_high [Hz] is obtained. When the control signal control[f] is set to 1, the signal addition unit 332 adds the input signal x_us[n−D1] of 2N in data length, which is output from the signal delay processor 331, and the wideband signal y_high[n] of 2N in data length, which is output from the high-frequency bandwidth extending unit 334, in the sampling frequency fs' [Hz], and obtains the wideband signal y[n] of 2N in data length as the output signal. As a result, the up-sampled input signal x[n−D1] is extended to a wideband by the wideband signal y_high[n], so that a signal extended to the bandwidth from fs_nb_low [Hz] to fs_wb_high [Hz] is obtained. When the control signal control[f] is set to 0 the signal addition unit 332 outputs the input signal x_us[n−D1] of 2N in data length, which is output from the signal delay processor 331, as the wideband signal y[n] of 2N in data length. That is, in this case, only the up-sampling is performed, but the extension in bandwidth is not performed.

According to the signal bandwidth extending apparatus applied with the signal bandwidth extending unit 3 configured as described above, when the speech signal which is the target signal and other non-target signals (noise components, echo components, reverberation components, music, etc.) are mixed in the input signal the bandwidth extension process cannot be always performed with high accuracy. Furthermore, the method of the bandwidth extension process can be changed according to the target signal degree which represents how much of the speech signals which are the target signals are included in the input signal. Therefore, when the target signal degree is high, it is possible to extend the bandwidth to be closer to the original sound by performing the bandwidth extending process on the target signal with high accuracy, so that the high speech quality can be maintained. When the target signal degree is low, the non-target signal is large. Therefore, since there is no need to perform the bandwidth extending process on the target signal with high accuracy by as much, the process is partially omitted to make the bandwidth extending process simpler, so that the computational load can be reduced.

Further, in this embodiment, the configuration is described such that only the input signal x[n] is input to the signal bandwidth extending unit 3 from the decoder 2. However, the information obtained by the decoder 2 or the information (for example, the linear prediction coefficient LPC[f, d] the linear prediction residual signal e[n], etc.) obtained by processing this information may be used by the signal bandwidth extending unit 3. As a result, the modules for calculating the respective signals are not necessary and thus the computational load can be reduced.

Modified Example of First Embodiment

Figure 8:
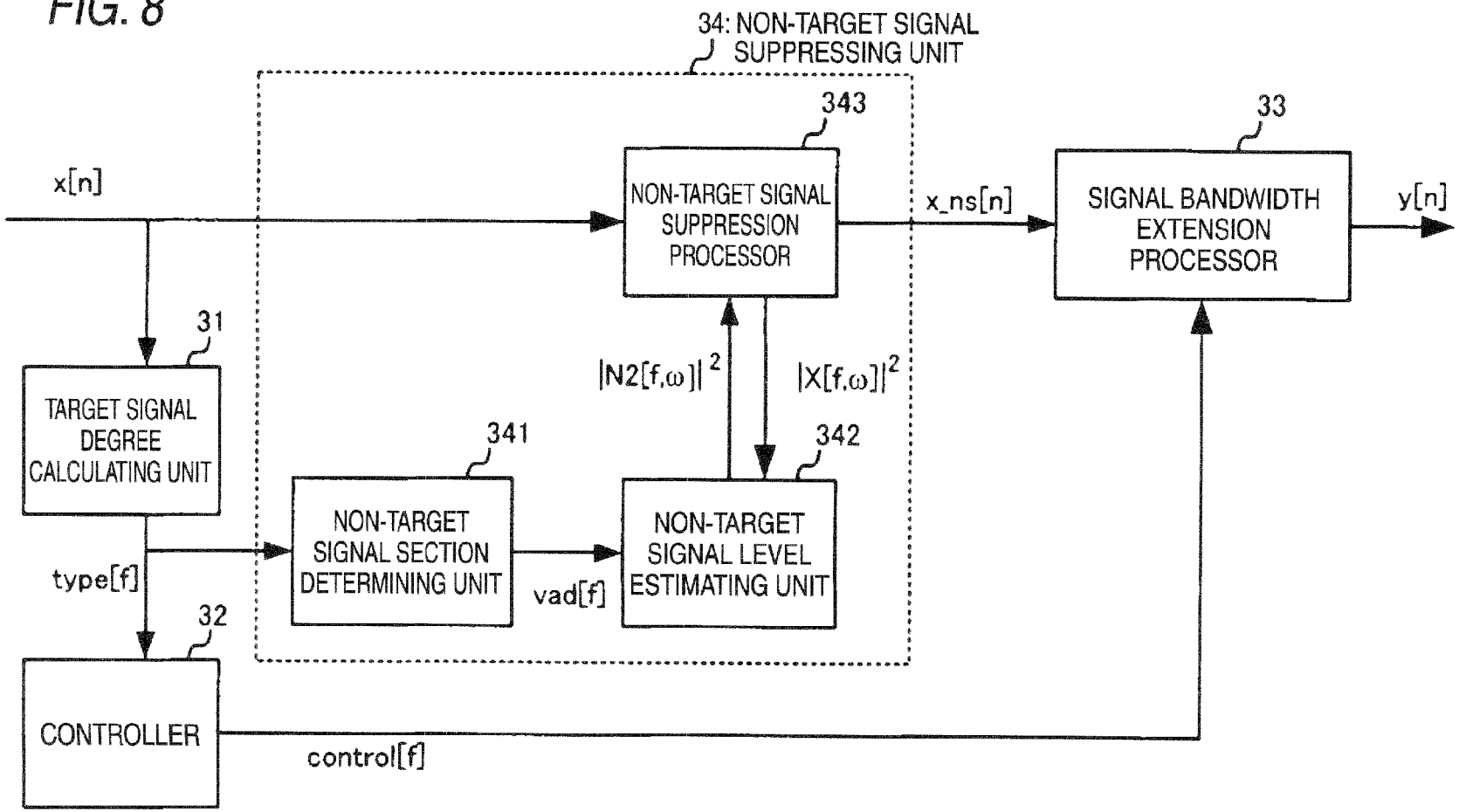
FIG. 8 is an exemplary circuit block diagram illustrating a modified example of a signal bandwidth extending unit shown in FIG. 2.
Figure 9:
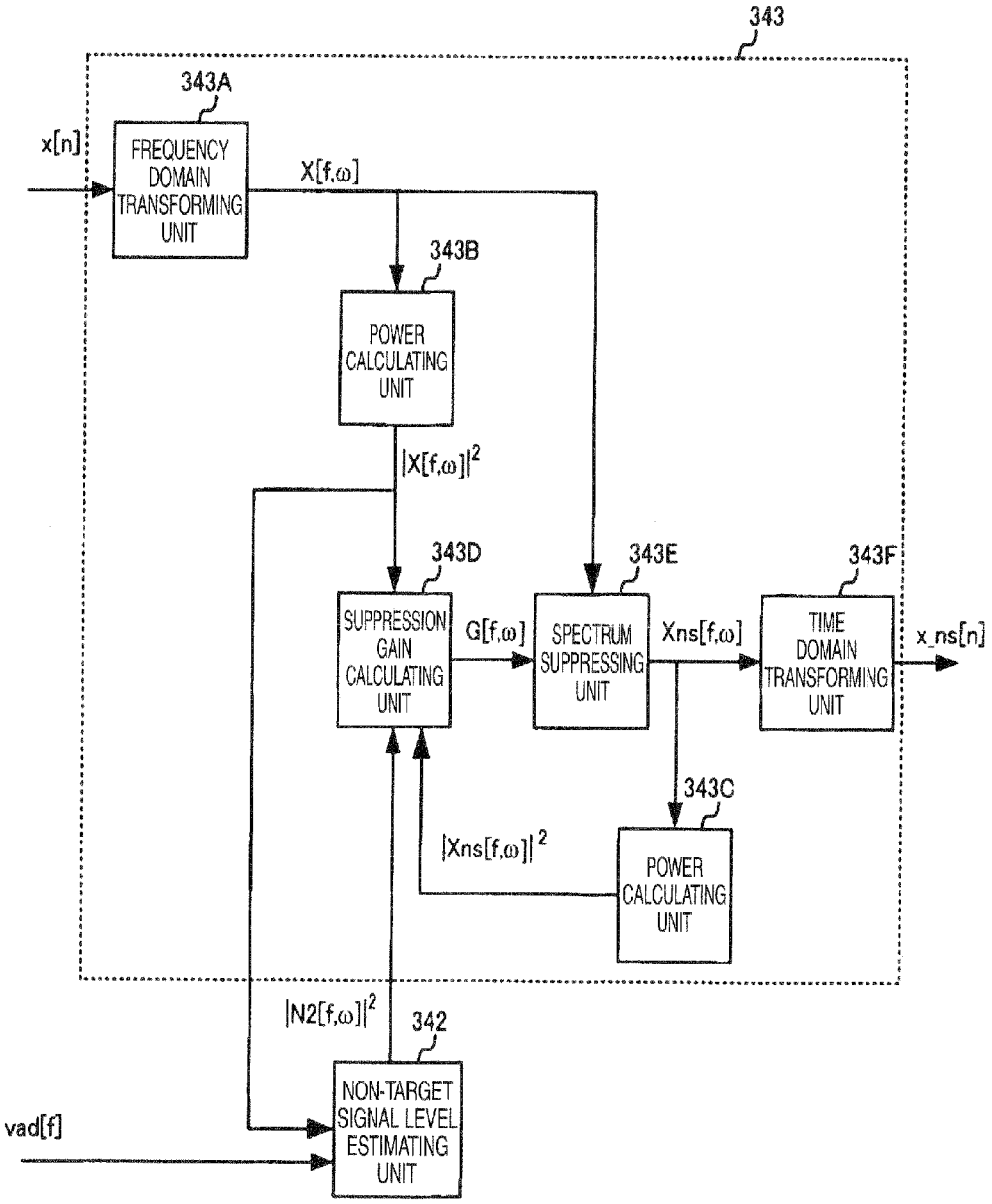
FIG. 9 is a circuit block diagram illustrating an exemplary configuration of a non-target signal suppressing unit of a signal bandwidth extending unit shown in FIG. 8.

A non-target signal suppressing unit 34 as shown in FIG. 8 may be added to the signal bandwidth extending unit 3. The non-target signal suppressing unit 34 is provided with a non-target signal section determining unit 341, a non-target signal level estimating unit 342, and a non-target signal suppression processor 343. As shown in FIG. 9, the non-target signal suppression processor 343 is provided with a frequency domain transforming unit 343A, a power calculating unit 343B, a power calculating unit 343C, a suppression gain calculating unit 343D, a spectrum suppressing unit 343E, and a time domain transforming unit 343F.

The non-target signal suppressing unit 34 suppresses the non-target signal components in the input signal x[n] using the target signal degree type[f] output from the target signal degree calculating unit 31, and inputs the signal x_ns[n], in which the non-target signal components are suppressed to the signal bandwidth extension processor 33. In this embodiment, the signal bandwidth extension processor 33 extends the bandwidth of the signal x_ns[n], in which the non-target signal components are suppressed, instead of the input signal x[n], and obtains the wideband signal y[n] as the output signal.

The non-target signal section determining unit 341 receives the target signal degree type[f] output from the target signal degree calculating unit 31, and outputs a frame determination value vad[f] which represents whether or not the section predominantly includes the non-target signal in the input signal in frame units based on the target signal degree type[f]. For example, when the target signal degree type[f] is less than the threshold value THR_B it is determined that the section predominantly includes the non-target signal, and thus the frame determination value vad[f] is output as 0. When the target signal degree type[f] is equal to or more than the threshold value THR_B, it is determined that the section predominantly does not include the non-target signal and thus the frame determination value vad[f] is output as 1.

The non-target signal level estimating unit 342 discards in frame units the power spectrum $|X[f, w]|^2$ of the input signal x[n] only in the sections in which the non-target signal are predominantly included with the frame determination value vad[f]=0 in the same ways as described in connection with Expression 2 using the power spectrum $|X[f, w]|^2$ (w=0, 1, . . . , M−1) of the input signal x[n] output from the non-target signal suppression processor 343 and the frame determination value vad[f] output from the non-target signal section determining unit 341. Then, the non-target signal level estimating unit 342 calculates the average power spectrum to be output as the power spectrum $|N2[f, w]|^2$ (w=0, 1, . . . , M−1) of the non-target signal in each frequency band. Further, in order to reduce the computational load, the power spectrum $|N[f, w]|^2$ of the non-target signal in each frequency band, which is output from the frequency spectrum updating unit 311D of the target signal degree calculating unit 31, may be used as $|N2[f, w]|^2$.

The non-target signal suppression processor 343 suppresses the non-target signal components from the input signal x[n] using the power spectrum $|N2[f, w]|^2$ (w=0, 1, . . . , M−1) of the non-target signal in each frequency band which is output from the non-target signal level estimating unit 342. Then, the non-target signal suppression processor 343 outputs the signal x_ns[n] in which the non-target signal components are suppressed. In addition, the non-target signal compression processor 343 also outputs the power spectrum $|X[f, w]|^2$ of the input signal x[n]. The non-target signal compression processor 343 is configured as shown in FIG. 9.

The frequency domain transforming unit 343A receives the input signal x[n] (n=0, 1, . . . , N−1) of the current frame f as in the case of the frequency domain transforming unit 311C. The frequency domain transforming unit 343A extracts the signals which correspond to an amount of the samples (2M) necessary for the frequency domain transformation, by using the input signal of the previous one frame or by performing zero padding or the like. The frequency domain transforming unit 343A performs the windowing on the extracted signals, performs the frequency domain transformation on the signals of 2M samples after the windowing, and outputs the frequency spectrum X[f, w] (w=0, 1, . . . , M−1) of the input signal.

The power calculating unit 343B calculates the power spectrum $|X[f, w]|^2$ (w=0, 1, . . . , M−1) of the input signal from the frequency spectrum X[f, w] (w=0, 1, . . . , M−1) of the input signal output from the frequency domain transforming unit 343A, and outputs the power spectrum $|X[f, w]|^2$.

The power calculating unit 343C calculates the power spectrum $|Xns[f, w]|^2$ (w=0, 1, . . . , M−1) of the suppressed signal from the frequency spectrum Xns[f, w] (w=0, 1, . . . , M−1) of the suppressed signal output from the spectrum suppressing unit 343E, and outputs the power spectrum $|Xns[f, w]|^2$.

The suppression gain calculating unit 343D outputs the suppression gain G[f, w] (w−0, 1, . . . , M−1) of each frequency band using the power spectrum $|X[f w]|^2$ (w==0, 1, . . . , M−1) of the input signal output from the power calculating unit 343B, the power spectrum $|N2[f, w]|^2$ (w=0, 1, . . . , M−1) of the non-target signal output from the non-target signal level estimating unlit 342, and the power spectrum $|Xns[f-1, w]|^2$ (w=0, 1, . . . , M−1) which is suppressed in the previous one frame and is output from the power calculating unit 343C.

For example, the calculation of the suppression gain G[f, w] is carried out by the following algorithms or the combination thereof. That is, a spectral subtraction method as a general noise canceller (S. F. Boll, "Suppression of acoustic noise in speech using spectral subtraction", IEEE Trans. Acoustics, Speech, and Signal Processing, vol. ASSP-29, pp. 113-120, 1979), a Wiener Filter method (J. S. Lim, A. V. Oppenheim, "Enhancement and bandwidth compression of noisy speech", Proc. IEEE Vol. 67, No. 12, pp. 1586-1604, December 1979), a Maximum likelihood method (R. J. McAulay, M. L. Malpass, "Speech enhancement using a soft-decision noise suppression filter", IEEE Trans on Acoustics, Speech, and Signal Processing, vol. ASSP-28, no. 2, pp. 137-145, April 1980), and the like. Here, the suppression gain G[f, w] is calculated using the Wiener Filter method as an example.

The spectrum suppressing unit 343E receives the frequency spectrum X[f, w] of the input signal output from the frequency domain transforming unit 343A and the suppression gain G[f, w] output from the suppression gain calculating unit 343D. The spectrum suppressing unit 343E separates the frequency spectrum X[f, w] of the input signal into an amplitude spectrum |X[f, w]| (w=0, 1, . . . , M−1) and a phase spectrum $\theta_x$[f, w] (w=0, 1, . . . , M−1) of the input signal. The spectrum suppressing unit 343E multiplies the amplitude spectrum |X[f, w]| of the input signal by the suppression gain G[f, w] which is set as the amplitude spectrum |Xns[f−1, w]| of the suppressed signal, sets the phase spectrum $\theta_x$[f, w] itself to the phase spectrum $\theta_{XNS}$ [f, w] of the suppressed signal, and then outputs the frequency spectrum Xns[f, w] (w=0, 1, . . . , M−1) of the suppressed signal.

The time domain transforming unit 343F receives the frequency spectrum Xns[f, w] (w=0, 1, . . . , M−1) of the suppressed signal output from the spectrum suppressing unit 343E. The time domain transforming unit 343F performs a process of transforming the time domain such as the Inverse Fast Fourier Transform (IFFT) so as to transform the input signal into the signal in the time domain. Then, in consideration of the amount overlapped by the windowing in the frequency domain transforming unit 343A, the time domain transforming unit 343F adds the suppressed signal x_ns[n] (n=0, 1, . . . , N−1) in the previous one frame and calculates the suppressed signal x_ns[n] (n=0, 1, . . . , N−1).

Also in such a configuration, the same effects can be exhibited. In addition, according to such a configuration, since the signal bandwidth extending process is performed on the signal in which the non-target signal components included in the input signal are suppressed, only the target signal can be subjected to the signal bandwidth extending process. Therefore, it can be advantageous to generate the wideband signal which is close to the original sound and has high speech quality. In addition, as described above, when it is configured such that the target signal degree calculating unit 31 and the non-target signal suppressing unit 34 are used together, the redundant processes can be reduced more than the case where it is configured such that the target signal degree calculating unit 31 operates independent of the non-target signal suppressing unit 34. Accordingly, the computational load can be reduced.

Second Embodiment

Figure 10:
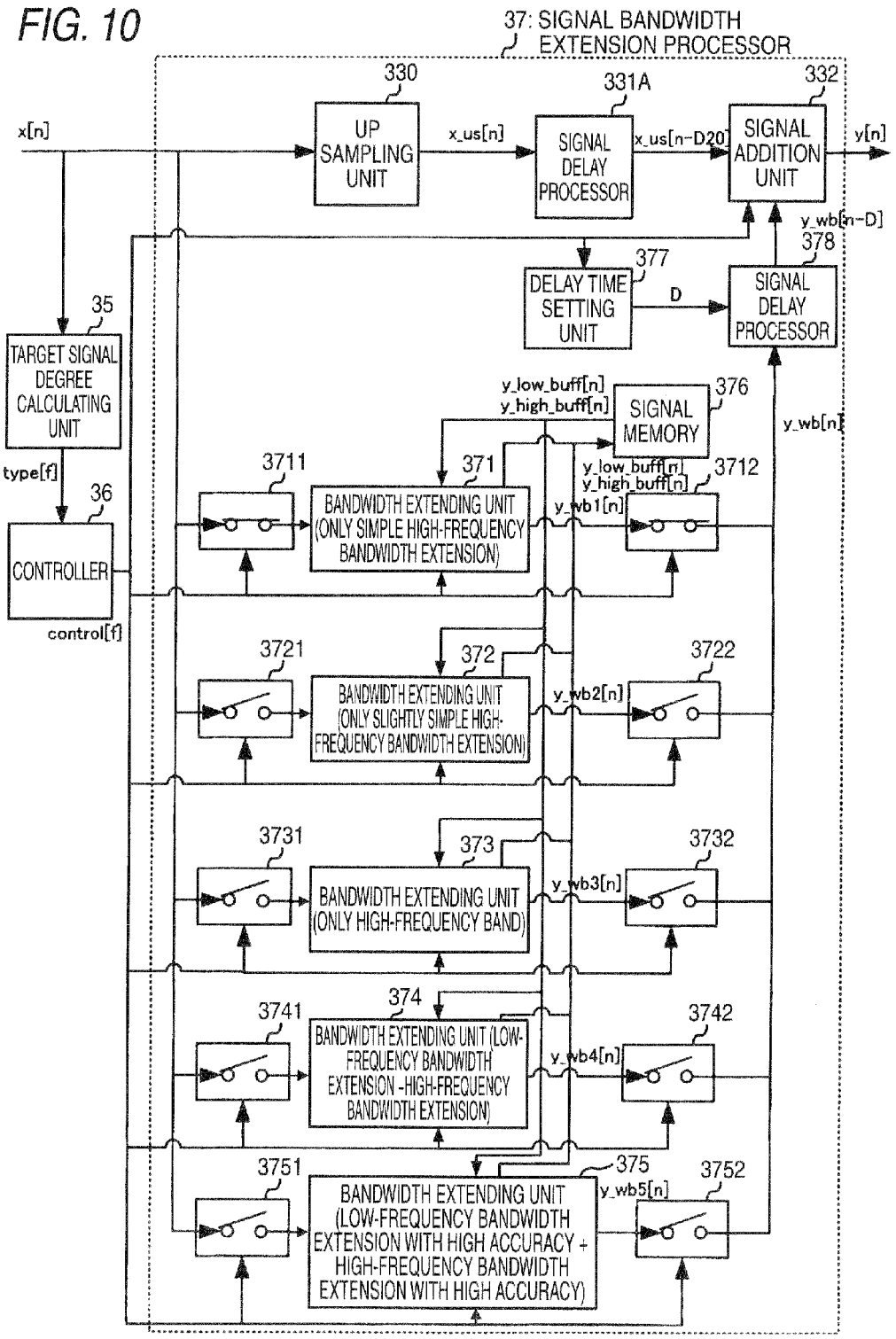
FIG. 10 is a circuit block diagram illustrating an exemplary configuration of a signal bandwidth extending unit of a signal bandwidth extending apparatus according to a second embodiment of the invention.

Next, a second embodiment of the invention will be described now. Since the configuration of this embodiment is the same as that of the first embodiment described with reference to FIGS. 1A and 1B, the description thereof will be omitted. FIG. 10 shows the configuration of the signal bandwidth extending unit 3 according to this embodiment. Further, in the following description the same configurations as those of the first embodiment are designated by the same reference numerals. For convenience of explanation, the description already given will be omitted as needed.

In the second embodiment, the input signal x[n] (n=0, 1, . . . , N−1) of the signal bandwidth extending unit 3 is limited in the bandwidth from fs_nb_low [Hz] to fs_nb_high [Hz]. The sampling frequency is changed from the sampling frequency fs [Hz] to the higher sampling frequency of fs' [Hz] by the bandwidth extending process of the signal bandwidth extending unit 3. The input signal is extended to the bandwidth from fs_wb_low [Hz] to fs_wb_high [Hz]. In this case, fs_wb_low≤fs_nb_low<fs_nb_high<fs/2≤fs_wb_high<fs'/2 is satisfied.

Further, in the following description, in order to exemplify the low-frequency bandwidth extension and the high-frequency bandwidth extension, fs_wb_low<fs_nb_low and fs_nb_high<fs_wb_high are assumed, for example, fs=8000 [Hz], fs'=16000 [Hz], fs_nb_low=340 [Hz], fs_nb_high=3950 [Hz], fs_wb_low=50 [Hz], and fs_wb_high=7950 [Hz]. In addition, here one frame is assumed to correspond to N samples (N=160). However, the frequency band with bandwidth limited, the sampling frequency, and the frame size are not limited by the setting values described above.

In the second embodiment, the signal bandwidth extending unit 3 includes a target signal degree calculating unit 35, a controller 36, and a signal bandwidth extension processor 37.

The signal bandwidth extension processor 37 is configured such that a bandwidth extending unit 371, a bandwidth extending unit 372, a bandwidth extending unit 373, a bandwidth extending unit 374, a bandwidth extending unit 375, switches 3711, 3712, 3721, 3722, 3731, 3732, 3741, 3742, 3751 and 3752 are additionally used instead of the high-frequency bandwidth extending unit 334, the low-frequency bandwidth extending unit 337, and the switches 333, 353, 336, and 338 of the signal bandwidth extension processor 33 according to the first embodiment. Moreover, the signal bandwidth extension processor 37 is configured to additionally include a signal memory 376, a delay time setting unit 377, and a signal delay processor 378.

The target signal degree calculating unit 35 according to the second embodiment has the same configurations as that of the target signal degree calculating unit 31 described in the first embodiment, and the description thereof will be omitted. Here, one frame is assumed to correspond to N/2 samples, which is half of the first embodiment, and the number of processes per time unit is increased. Therefore, the target signal degree type[f] is calculated with higher accuracy than the target signal degree calculating unit 31.

The controller 36 according to the second embodiment receives the target signal degree type[f] output from the target signal degree calculating unit 35. The controller 36 outputs the control signal control[f] which controls one of the bandwidth extending unit 371, the bandwidth extending unit 372, the bandwidth extending unit 373, the bandwidth extending unit 374, and the bandwidth extending unit 375 so as to operate or not operate according to the target signal degree type[f]. Specifically, when the control signal control[f] is set to 0, the switches 3711, 3712, 3721, 3722, 3731, 3732, 3741, 3742, 3751, and 3752 are opened, and the bandwidth extending units 371 to 375 do not operate. When the control signal control[f] is set to 1, only the switches 3711 and 3712 are closed, and only the bandwidth extending unit 371 operates. When the control signal control[f] is set to 2, only the switches 3721 and 3722 are closed, and only the bandwidth extending unit 372 operates. When the control signal control [f] is set to 3, only the switches 3731 and 3732 are closed, and only the bandwidth extending unit 373 operates. When the control signal control[f] is set to 4, only the switches 3741 and 3742 are closed, and only the bandwidth extending unit 374 operates. When the control signal control[f] is set to 5, only the switches 3751 and 3752 are closed, and only the bandwidth extending unit 375 operates.

Figure 11:
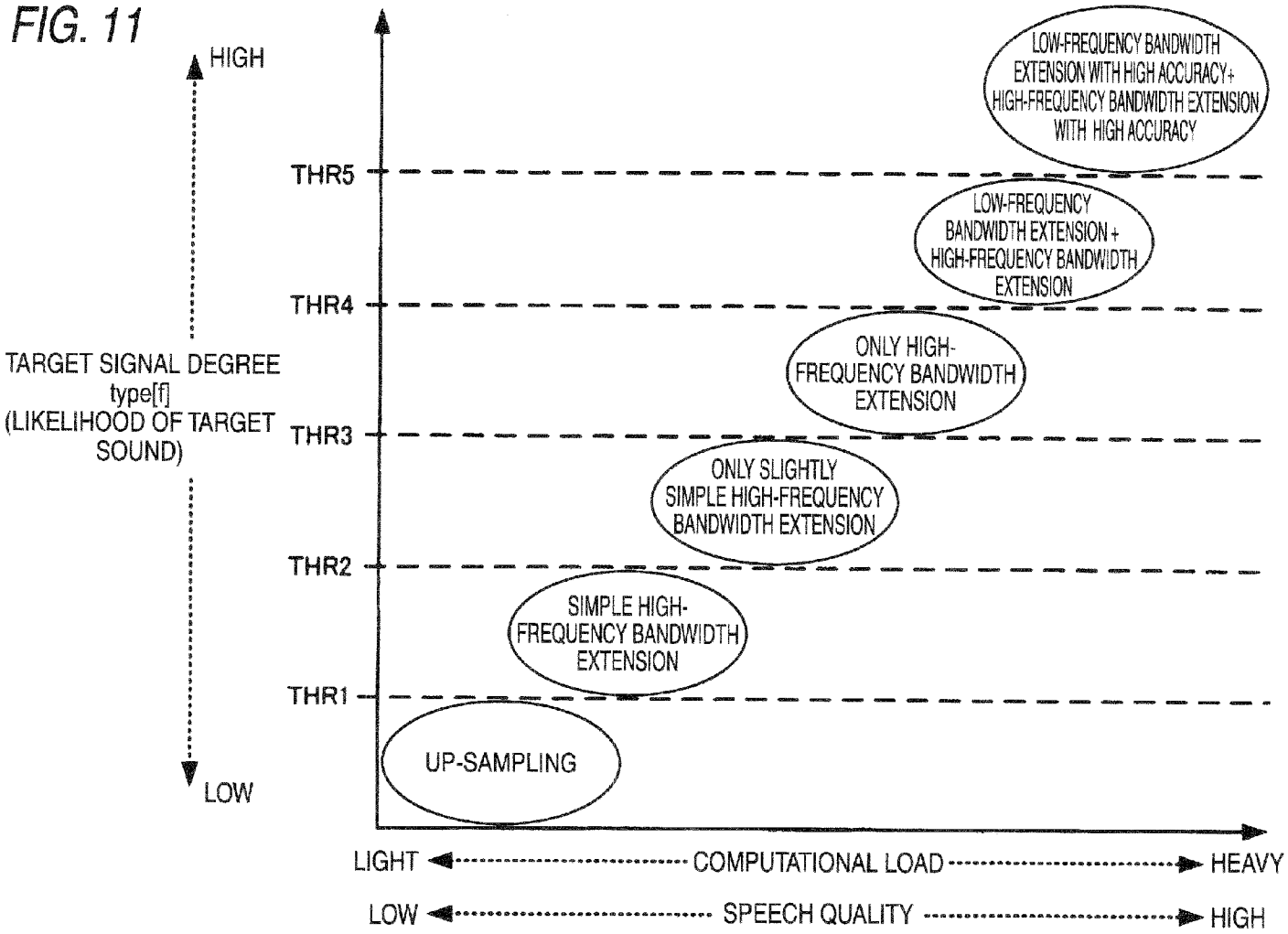
FIG. 11 is an exemplary view illustrating an operation of a controller of a signal extending unit shown in FIG. 10.

FIG. 11 shows the control operation of the controller 36. Such a controller 36 performs control such that, as the degree of the target signal is lowered, the processing of the bandwidth extension processing method is simplified and is performed with low speech quality. As the degree of the target signal is raised, the processing of the bandwidth extension processing method is accurately performed with high speech quality. In general, as the bandwidth extension processing method is performed with lower speech quality, the process is simplified. Therefore, the computational load becomes light. As the bandwidth extension processing method is performed with higher speech quality the process is complicated with high accuracy. Therefore, the computational load becomes heavy. In such a controller 36, as the degree of the target signal is lowered, the processes performing the operation are partially omitted, or the extending frequency bandwidth is narrowed, or the processing unit becomes larger, so that the control is performed such that the bandwidth extending process is simplified and is performed with low speech quality.

The case where the bandwidth extending unit 371 shown in FIG. 10 operates corresponds to the case where "only simple high-frequency bandwidth extension" shown in FIG. 11 is performed. The case where the bandwidth extending unit 372 shown in FIG. 10 operates corresponds to the case where "only slightly simple high-frequency bandwidth extension" shown in FIG. 11 is performed. The case where the bandwidth extending unit 373 shown in FIG. 10 operates corresponds to the case where "only high-frequency bandwidth extension" shown in FIG. 11 is performed. The case where the bandwidth extending unit 374 shown in FIG. 10 operates corresponds to the case where "low-frequency bandwidth extension+high-frequency bandwidth extension" is performed. The case where the bandwidth extending unit 375 shown it FIG. 10 operates corresponds to the case where "low-frequency bandwidth extension with high accuracy+high-frequency bandwidth extension with high accuracy" shown in FIG. 11 is performed. The case where the bandwidth extending units 371 to 375 shown in FIG. 10 do not operate corresponds to the case where only the up-sampling shown in FIG. 11 is performed. That is, using the target signal degree type[f], the controller 36 controls which one of the bandwidth extending units 371 to 375 to operate or which one of the bandwidth extending units 371 to 375 not to operate. Therefore, it is possible to perform the bandwidth extending process with high accuracy and with high speech quality as the degree of the target signal is raised.

Figure 12:
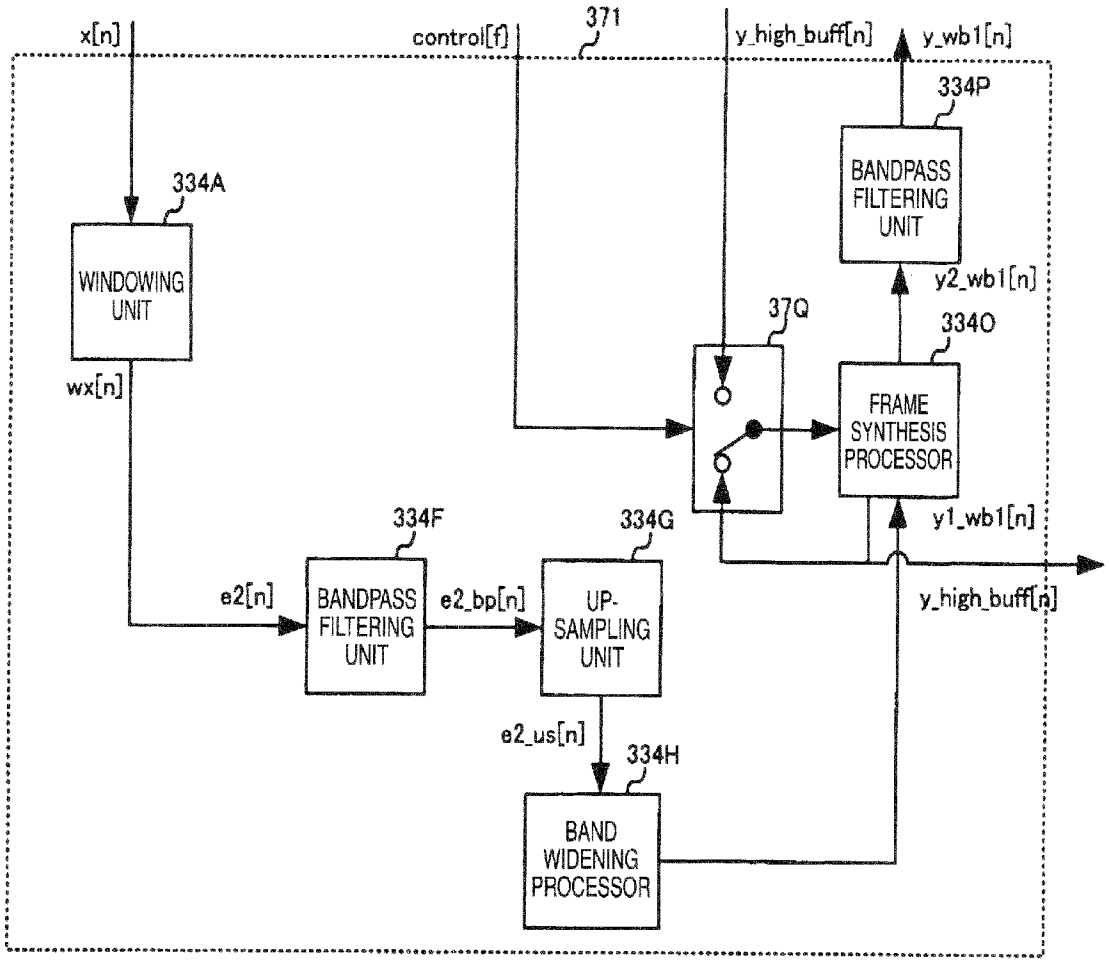
FIG. 12 is a circuit block diagram illustrating an exemplary configuration of a first bandwidth extending unit of a signal bandwidth extending unit shown in FIG. 10.

FIG. 12 is a block diagram illustrating an exemplary configuration of the bandwidth extending unit 371. The bandwidth extending unit 371 receives the input signal x[n], and outputs the wideband signal y_wb1[n] in which the frequency bandwidth from fs_nb_high [Hz] to fs_wb_high [Hz] in a high frequency band is extended. The bandwidth extending unit 371 is configured such that the process block relating to the analysis and synthesis (the synthesis of the linear prediction analysis and the spectral envelope) of the spectral parameter, and the process block relating to the voiced/unvoiced sound estimation are removed from the high-frequency bandwidth extending unit 334 shown in FIG. 5 and a switch 37Q is provided. In this way, the processes are significantly reduced, so that the simple high-frequency bandwidth extending process can be realized. In addition, when operating the bandwidth extending unit 371 outputs the temporal second half data (which has the data length of 2N) of y1_wb1[n] output from the band widening processor 334H as the high-frequency bandwidth extending data y_high_buff[n] to the signal memory 376, and outputs the zero signal which is obtained by making all sample values be equal to zero, as the low-frequency bandwidth extending data y_low_buff[n] to the signal memory 376. Similarly in the following description the data length of the signals y_high_buff[n] and y_low_buff [n] which are input to or output from the signal memory 376 is set in consideration of the overlap in the windowing unit 334A and the windowing unit 337A.

Figure 13:
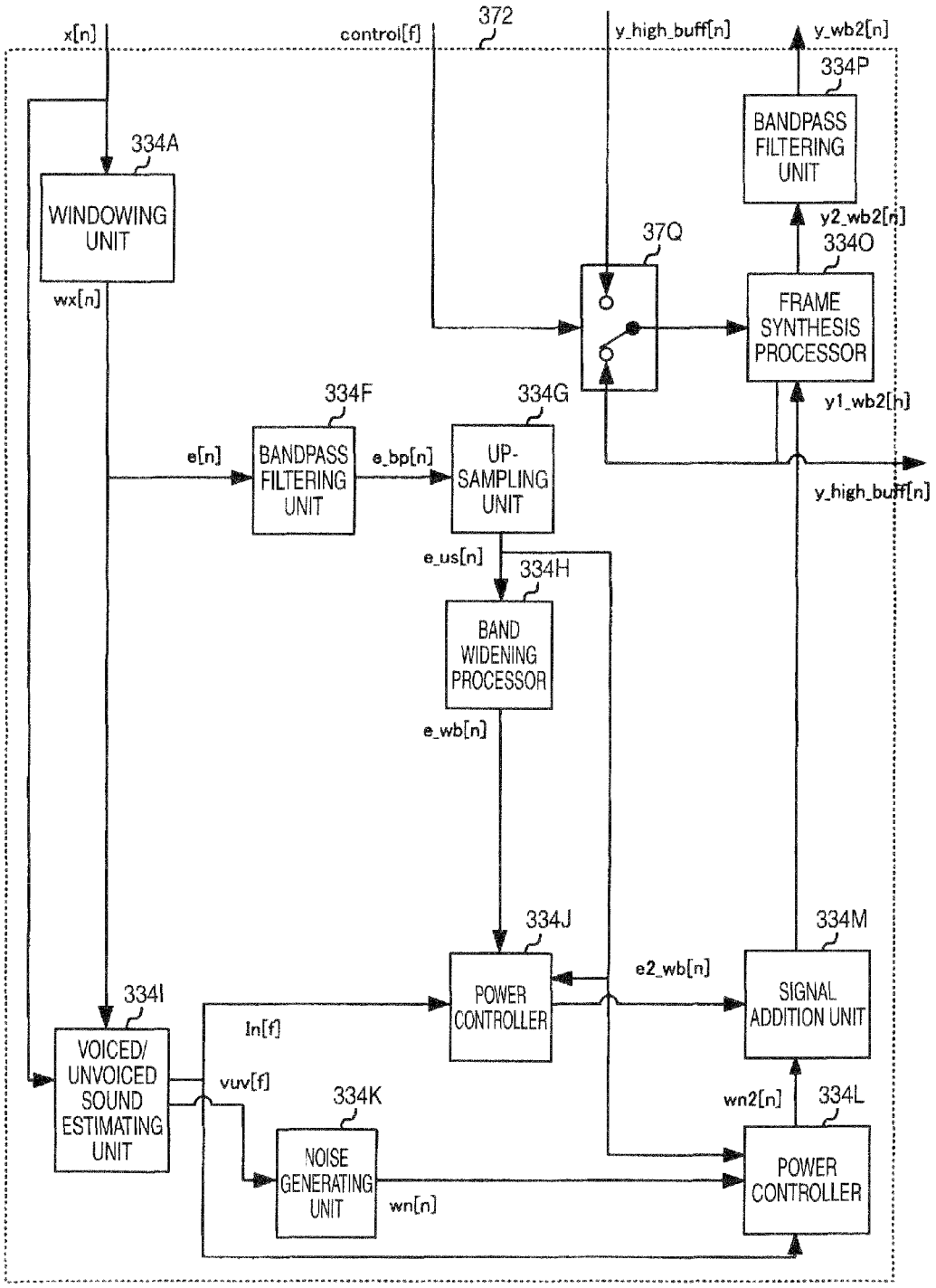
FIG. 13 is a circuit block diagram illustrating an exemplary configuration of a second bandwidth extending unit of a signal bandwidth extending unit shown in FIG. 10.

Further, by the control of the controller 36, only the first frame, which is switched so as to operate the bandwidth extending unit 371 in the bandwidth extending process performed by the signal bandwidth extension processor 37, is switched by the switch 37Q. When the switch 37Q is switched, the frame synthesis processor 334O of the bandwidth extending unit 371 adds the temporal first half data (which has the data length of 2N) of the high-frequency bandwidth extending data y1_wb1[n], which is extended by the band widening processor 334H, and the high-frequency bandwidth extending data y_high_buff[n] (which substantially corresponds to the signal in the previous one frame) of 2N in data length which is stored in the signal memory 376, and outputs the added data as y2_wb1[n]. As a result, the signal is smoothened in the time direction and it is possible to remove a feeling of discontinuity in sound which may occur when the signal bandwidth extension processor 37 switches the bandwidth extension processing method, FIG. 13 is a block diagram illustrating an exemplary configuration of the bandwidth extending unit 372. The bandwidth extending unit 372 receives the input signal x[n], and outputs the wideband signal y_wb2[n] in which the frequency bandwidth from fs_nb_high [Hz] to fx_wb_high [Hz] in a high frequency band is extended. The bandwidth extending unit 372 is configured such that the process block relating to the analysis and synthesis (the synthesis of the linear prediction analysis and the spectral envelope) of the spectral parameter is removed from the high-frequency bandwidth extending unit 334 shown in FIG. 5. For this reason, the computational load of the bandwidth extending unit 372 can be reduced more than that of the high-frequency bandwidth extending unit 334 shown in FIG. 5. In this case, since the bandwidth extending unit 372 includes the process block relating to the voiced/unvoiced sound estimation the bandwidth extending unit 372 can perform the high-frequency bandwidth extending process with higher accuracy than the bandwidth extending unit 371 shown in FIG. 12. In addition, when operating, the bandwidth extending unit 372 outputs the temporal second half data (which has the data length of 2N) of y1_wb2[n] which is output from the signal addition unit 334M as the high-frequency bandwidth extending data y_high_buff[n], and outputs the zero signal as the low-frequency bandwidth extending data y_low_buff[n] to the signal memory 376.

Only the first frame, which is switched so as to operate the bandwidth extending unit 372, is switched by the switch 37Q. When the switch 37Q is switched, the frame synthesis processor 334O of the bandwidth extending unit 372 adds the temporal first half data (which has the data length of 2N) of the high-frequency bandwidth extending data y1_wb2[n] and the high-frequency bandwidth extending data y_high_buff[n] (which substantially corresponds to the signal in the previous one frame) which is stored in the signal memory 376, and outputs the added data as y2_wb2[n]. As a result, the signal is smoothened in the time direction, and it is possible to remove a feeling of discontinuity in sound which may occur when the signal bandwidth extension processor 37 switches the bandwidth extension processing method.

Figure 14:
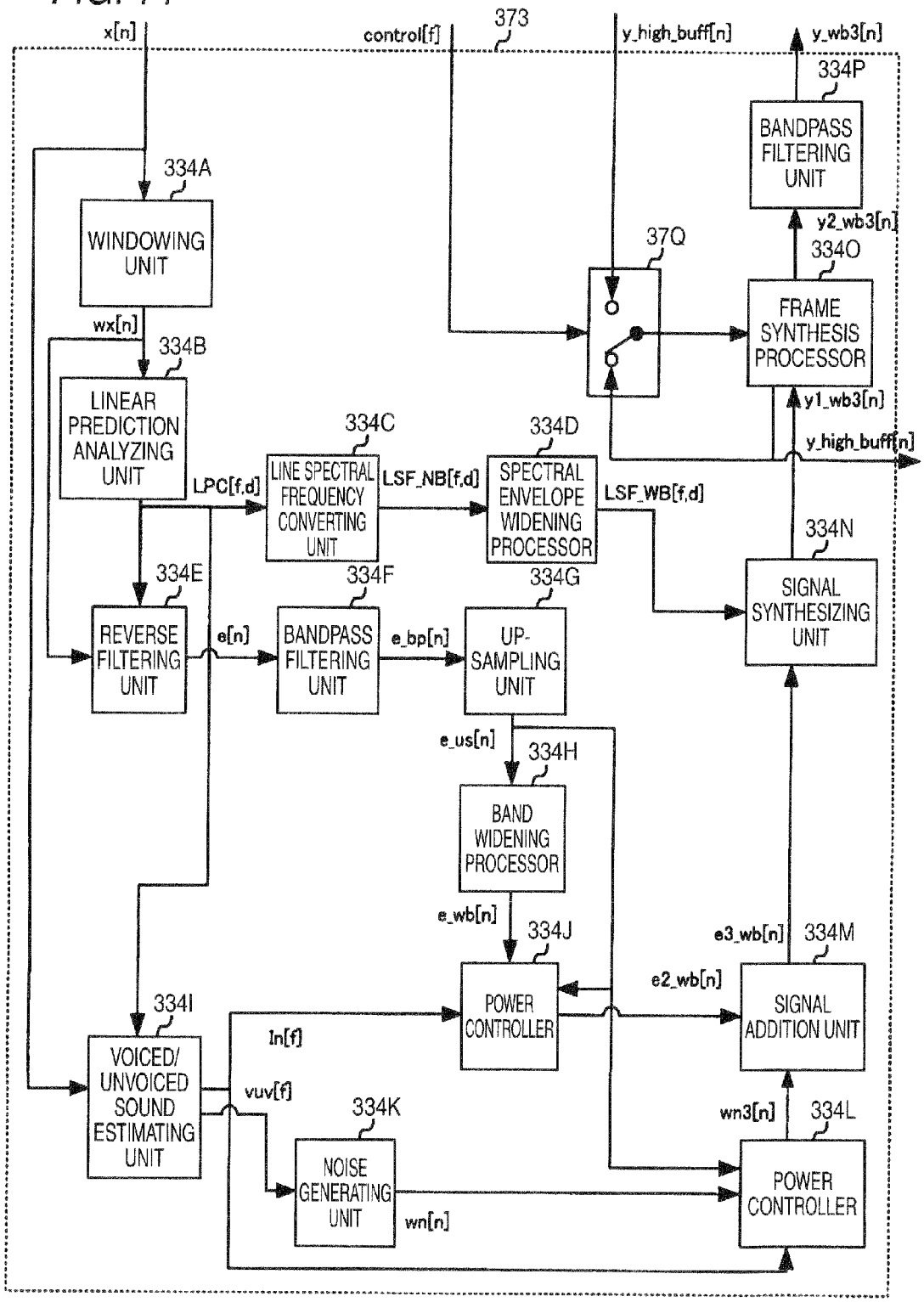
FIG. 14 is a circuit block diagram illustrating an exemplary configuration of a third bandwidth extending unit of a signal bandwidth extending unit shown in FIG. 10.

FIG. 14 is a block diagram illustrating an exemplary configuration of the bandwidth extending unit 373. The bandwidth extending unit 373 receives the input signal x[n] and outputs the wideband signal y_wb3[n] in which the frequency bandwidth from fs_ns_high [Hz] to fs_wb_high [Hz] in a high frequency band are extended. The bandwidth extending unit 373 is configured such that the switch 37Q is provided at the high-frequency bandwidth extending unit 334 shown in FIG. 5. In addition, when operating the bandwidth extending unit 373 outputs the temporal second half data (which has the data length of 2N) of y1_wb3[n], which is output from the signal synthesizing unit 334N, as the high-frequency bandwidth extending data y_high_buff[n] to the signal memory 376. The bandwidth extending unit 373 outputs the zero signal as the low-frequency bandwidth extending data y_low_buff[n] to the signal memory 376.

Similarly only the first frame, which is switched so as to operate the bandwidth extending unit 373, is switched by the switch 37Q. When the switch 37Q is switched, the frame synthesis processor 334O of the bandwidth extending unit 373 adds the temporal first half data (which has the data length of 2N) of the high-frequency bandwidth extending data y1_wb3[n] and the high-frequency bandwidth extending data y_high_buff[n] (which substantially corresponds to the signal in the previous one frame) which is stored in the signal memory 376, and outputs the added data as y2_wb3[n]. As a result, the signal is smoothened in the time direction, and it is possible to remove a feeling of discontinuity in sound which may occur when the signal bandwidth extension processor 37 switches the bandwidth extension processing method.

Figure 15:
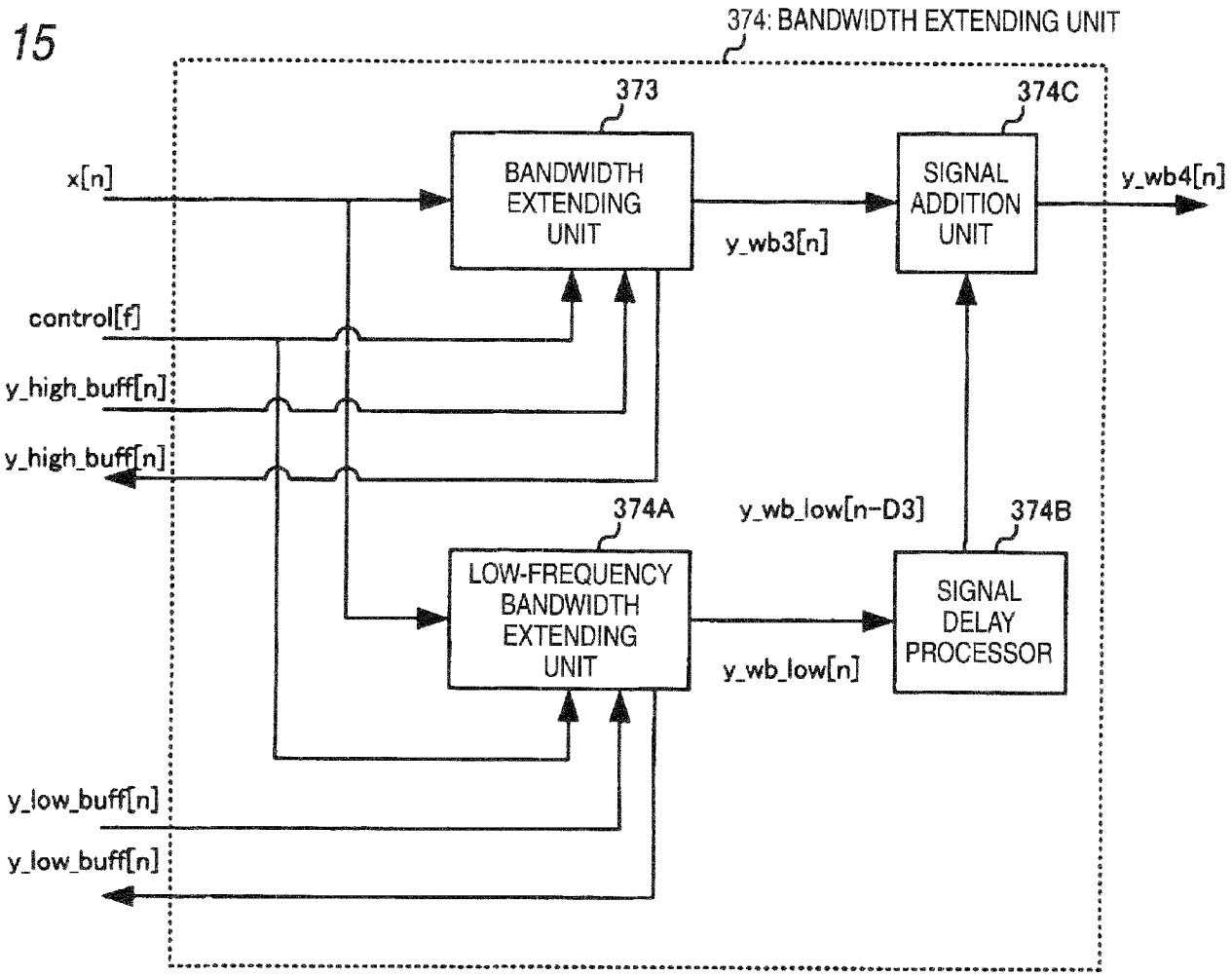
FIG. 15 is a circuit block diagram illustrating an exemplary configuration of a fourth bandwidth extending unit of a signal bandwidth extending unit shown in FIG. 10.

FIG. 15 is a block diagram illustrating an exemplary configuration of the bandwidth extending unit 374. The bandwidth extending unit 374 is configured to include the bandwidth extending unit 373 shown in FIG. 14, a low-frequency bandwidth extending unit 374A, a signal delay processor 374B, and a signal addition unit 374C. For this reason, the computational load of the bandwidth extending unit 374 increases more than that of the high-frequency bandwidth extending unit 334 shown in FIG. 5 or that of the bandwidth extending unit 373 shown in FIG. 14. However, since the low-frequency bandwidth extending process is included, it is possible to generate a signal with higher accuracy which is closer to the original sound. The bandwidth extending unit 374 receives the input signal x[n], and outputs the wideband signal y_wb4[n] in which the frequency bandwidth from fs_nb_high [Hz] to fs_wb_high [Hz] in a high frequency band and the frequency bandwidth from fs_wb_low [Hz] to fs_nb_low [Hz] in a low-frequency band are extended. In addition, when operating, the bandwidth extending unit 373 of the bandwidth extending unit 374 outputs the temporal second half data (which has the data length of 2N) of y1_wb4[n] which is output from the signal synthesizing unit 334N as the high-frequency bandwidth extending data y_high_buff[n] to the signal memory 376.

Figure 16:
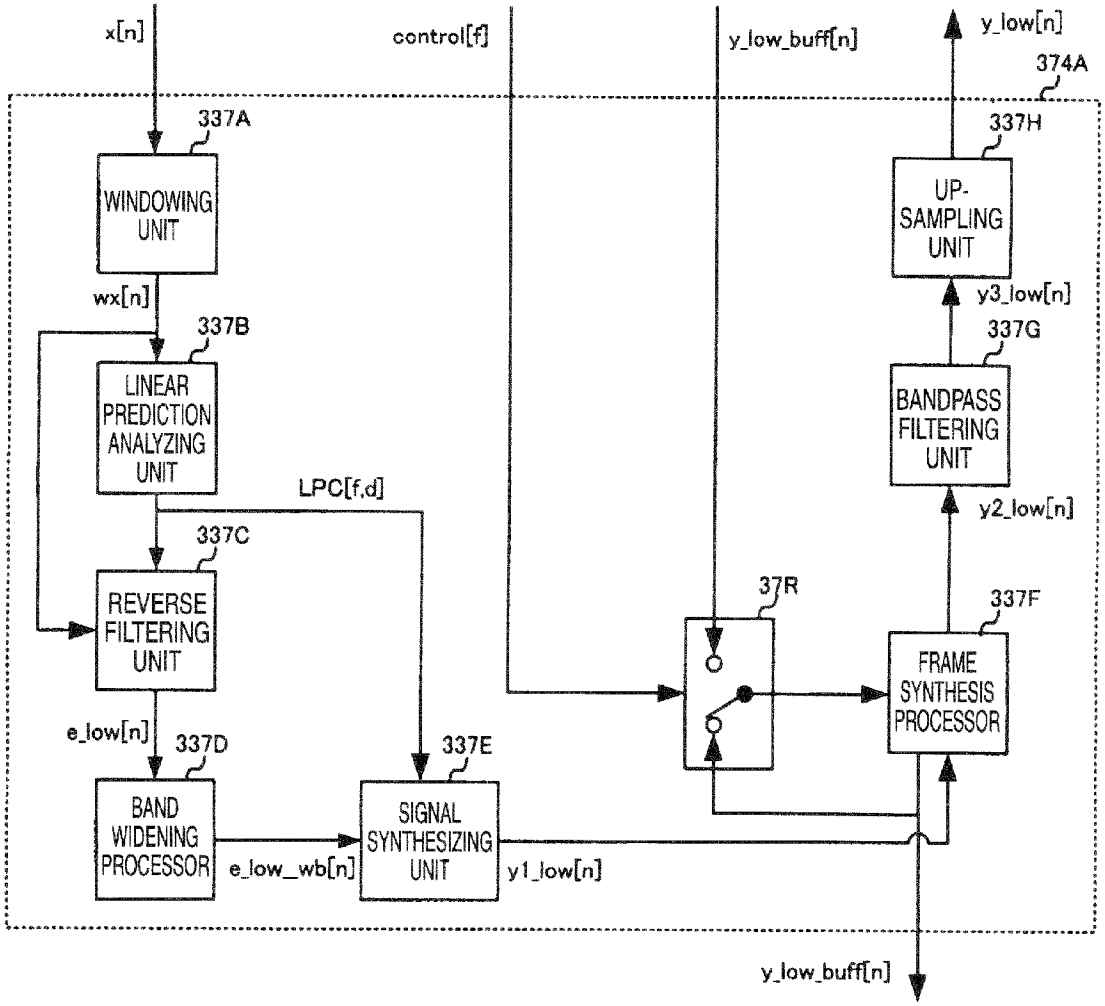
FIG. 16 is a circuit block diagram illustrating an exemplary configuration of a low-frequency bandwidth extending unit of a signal bandwidth extending unit shown in FIG. 15.

FIG. 16 is a block diagram illustrating an exemplary configuration of the low-frequency bandwidth extending unit 374A shown in FIG. 15. The bandwidth extending unit 374A is configured such that the switch 37R is provided at the bandwidth extending unit 337 shown in FIG. 7. The bandwidth extending unit 374A receives the input signal x[n], and outputs the wideband signal y_wb_low[n] in which the frequency bandwidth from fs_wb_low [Hz] to fs_nb_low [Hz] in a low-frequency band is extended. In addition, when operating, the bandwidth extending unit 374A outputs the temporal second half data (which has the data length of 2N) of y1_low[n] which is output from the signal synthesizing unit 337E, as the low-frequency bandwidth extending data y_low_buff[n]], to the signal memory 376.

Further by the control of the controller 36, only the first frame, which is switched so as to operate the bandwidth extending unit 374 in the bandwidth extending process performed by the signal bandwidth extension processor 37, is switched by the switch 37R. When the switch 37R is switched the frame synthesis processor 337F of the bandwidth extending unit 374A adds the temporal first half data (which has the data length of 2N) of the high-frequency bandwidth extending data y1_low[n], which is synthesized by the signal synthesizing unit 337E, and the low-frequency bandwidth extending data y_low_buff[n] (which substantially corresponds to the signal in the previous one frame) which is stored in the signal memory 376, and outputs the added data as y2_low[n]. As a result, the signal is smoothened in the time direction, and it is possible to remove a feeling of discontinuity in sound which may occur when the signal bandwidth extension processor 37 switches the bandwidth extension processing method.

The signal delay processor 374B delays the signal y_wb_low[n], which is output from the low-frequency bandwidth extending unit 374A, by buffering for only a predetermined time (D3 samples) and outputs y_wb_low[n−D3]. Therefore, the signal delay processor 374B synchronizes the signal y_wb3[n] output from the bandwidth extending unit 373 by matching the timing with each other. That is, the predetermined time (D3 samples) corresponds to the value (D3=D_high1−D_low1) which is obtained by subtracting the process delay time D_low1 which is the time taken from the input to the output in the low-frequency bandwidth extending unit 374A, from the process delay time D_high1 which is the time taken from the input to the output in the bandwidth extending unit 373. The value is calculated in advance, and D3 is always used as a fixed value.

The signal addition unit 374C adds the wideband signal y_wb_low[n−D3] output from the signal delay processor 374B and the wideband signal y_wb3[n] output from the bandwidth extending unit 373 at the sampling frequency fs' [Hz], and obtains and outputs the wideband signal y_wb4[n].

Figure 17:
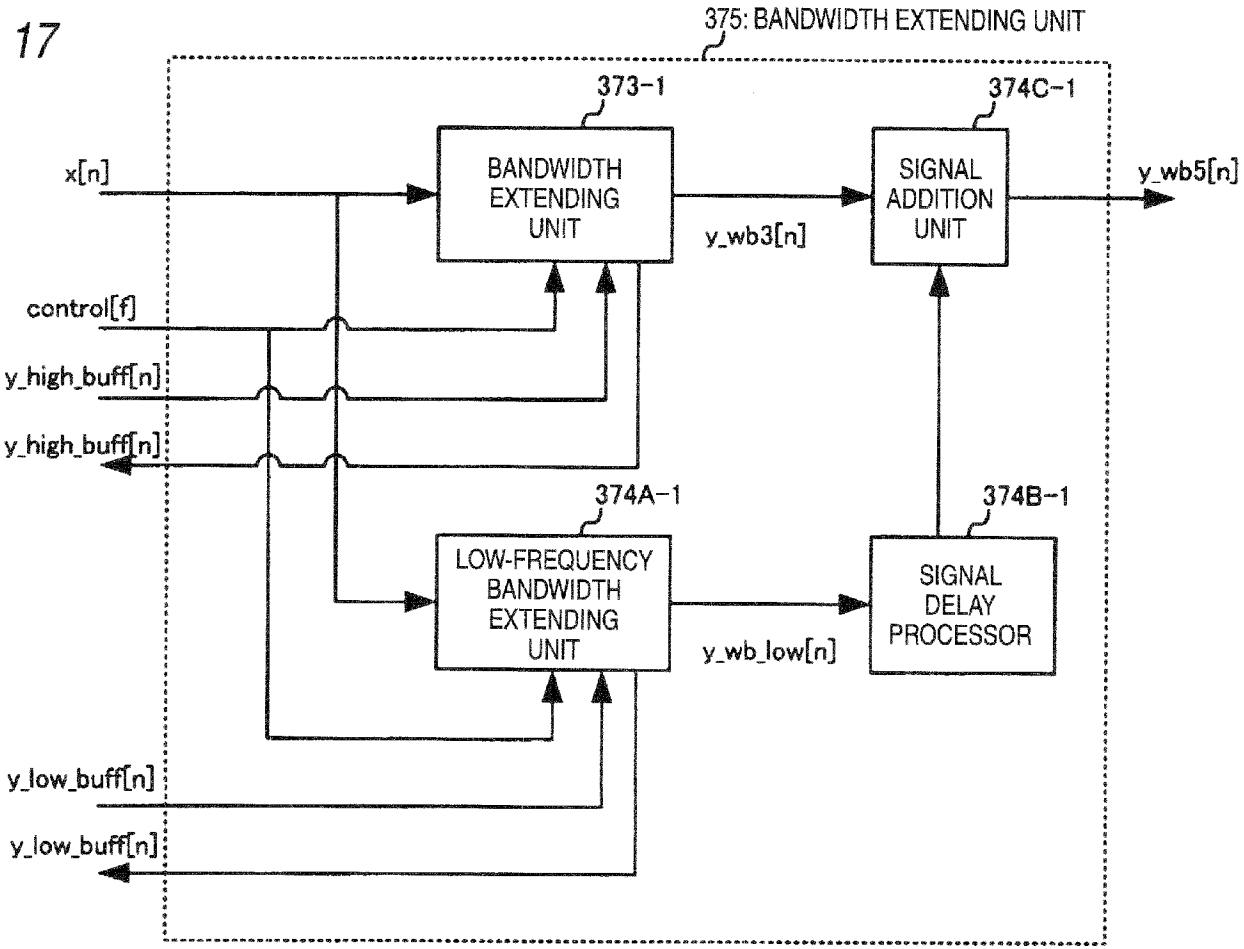
FIG. 17 is a circuit block diagram illustrating an exemplary configuration of a fifth bandwidth extending unit of a signal bandwidth extending unit shown in FIG. 10.

FIG. 17 is a block diagram illustrating an exemplary configuration of the bandwidth extending unit 375. The bandwidth extending unit 375 has the same configuration as that of the bandwidth extending unit 374. The bandwidth extending unit 375 sets a process unit (one frame) to N/2 samples at which the bandwidth extending process is performed by the bandwidth extending unit 375, and thus the process unit is half the size of the bandwidth extending unit 374. Thus, the process time interval is shortened; the number of processes per time unit increases; and the extension process is performed with higher accuracy than that of the bandwidth extending unit 374. For this reasons in the bandwidth extending unit 374, the computational load becomes heavier than that of the process performed by the bandwidth extending unit 374 shown in FIG. 14. However, the number of processes per time unit increases, so that the accuracy in the time direction increases, and thus it is possible to generate the signal with higher accuracy and closer to the original sound. Of course, one frame is not limited to N/2 samples, but the number of samples of one frame may be any value as long as the frame sample size per time unit in the bandwidth extending process is small and the time analysis length is shortened as the target signal degree type[f] is higher.

The bandwidth extending unit 375 shown in FIG. 17 is configured to include a bandwidth extending unit 373-1, a low-frequency bandwidth extending unit 374A-1, a signal delay processor 374B-1, and a signal addition unit 374C-1. The bandwidth extending unit 375 is configured such that one frame of each of the bandwidth extending unit 373, the low-frequency bandwidth extending unit 374A, the signal delay processor 374B, and the signal addition unit 374C is set to N/2 samples and the number of processes per time unit increases twice. Therefore, since the operation is not changed, an explanation thereof will be omitted.

The bandwidth extending unit 375 receives the input signal x[n], and outputs the wideband signal y_wb5[n] in which the low-frequency bandwidth from fs_wb_low [Hz] to fs_nb_low [Hz] and the high frequency bandwidth from fs_nb_high [Hz] to fs_wb_high [Hz] are extended. In addition, similarly to the bandwidth extending unit 374, when operating the bandwidth extending unit 375 outputs y1_wb4[n], which is output from the signal synthesizing unit 334N, as the high-frequency bandwidth extending data y_high_buff[n] to the signal memory 376.

When any one of the bandwidth extending units 371 to 375 is operating, the signal memory 376 receives the high-frequency bandwidth extending data y_high_buff[n] and the low-frequency bandwidth extending data y_low_buff[n] from one of the operating bandwidth extending units 371 to 375. In addition, when the bandwidth extending units 371 to 375 do not operate, the signal memory 376 sets both the high-frequency bandwidth extending data y_high_buff[n] and the low-frequency bandwidth extending data y_low_buff [n] as the zero signal. Then, in the case of the first frame when the control signal control[f] is switched from 1 to 5, the signal memory 376 properly outputs the high-frequency bandwidth extending data h_high_buff[n] and the low-frequency bandwidth extending data y_low_buff[n] to one of the operating bandwidth extending units 371 to 375.

The delay time setting unit 377 has a different process delay time according to which one of the bandwidth extending units 371 to 375 is used to extend the bandwidth. Therefore, the process delay times taken from the input to the output of the bandwidth extending process are obtained in advance with respect to the respective bandwidth extending units 371 to 375; and the maximum delay time D_max among the process delay times is obtained. It is determined which one of the bandwidth extending units 371 to 375 is used to extend the bandwidth according to the control signal control[f] output from the controller 36. Thus, even when any one of the bandwidth extending units 371 to 375 is operating, the predetermined delay time is set as the signal delay time D which is taken in the signal delay processor 378 such that the delay time is matched with the maximum delay time D_max. For example, when the delay times taken from the input to the output of the bandwidth extending units 371 to 375 are respectively assumed as D21, D22, D23, D24, and D25 samples, among these the maximum delay time D_max is obtained. The delay time D is set such that when the bandwidth extending unit 371 operates, D is set to D_max−D21; when the bandwidth extending unit 372 operates, D is set to D_max−D22; when the bandwidth extending unit 373 operates, D is set to D_max−D23, when the bandwidth extending unit 374 operates, D is set to D_max−D24; when the bandwidth extending unit 375 operates, D is set to D_max−D25. These values are obtained in advance and are always used as fixed values. As a result, even when the various processes of the bandwidth extension with different delay time are switched, it is possible to generate the signal which is synchronized with every frequency band by matching the timing with each other. In addition, it is possible to prevent no sound or the abnormal sound from generating before and after the bandwidth extending processes are switched. Therefore, it is possible to generate the signal closer to the original sound. Further, when the bandwidth extending units 371 to 375 do not operate, the delay time setting unit 377 does not operate.

The signal delay processor 378 sets the wideband signal output to y_wb[n] by using any one of the bandwidth extending units 371 to 375, delays the wideband signal by buffering for only a predetermined time (D samples) which is set by the delay time setting unit 377, and outputs the accumulated signal as y_wb[n−D]. Further, when the bandwidth extending units 371 to 375 do not operate, the signal delay processor 378 does not operate.

The signal delay processor 331A delays the input signal x_us[n], which is output from the up-sampling unit 330, by buffering for only a predetermined time (D20 samples), and outputs the accumulated signal as x_us[n−D20]. Thus, the wideband signal output by any one of the bandwidth extending units 371 to 375 is synchronized with y_wb[n−D] by matching the timing with each other. That is, the predetermined time (D20 samples) corresponds to the value (D20=D_max−D_us) which is obtained by subtracting the process delay time D_us taken from the input to the output of the up-sampling unit 330 from the above-mentioned maximum process delay time D_max taken from the input to the output of the bandwidth extending units 371 to 375. The value is obtained in advance, and D20 is always used as a fixed value.

The wideband signal y_wb[n−D], which is extended by any one of the bandwidth extending units 371 to 375 described above and is delayed by the signal delay processor 378, and the input signal x_us[n−D20], which is up-sampled by the up-sampling unit 330 and is delayed by the signal delay processor 331A, are input to the signal addition unit 332. Then, the signal addition unit 332 adds two signals and outputs the added signal as the output signal y[n].

By changing the bandwidth extension processing method according to the target signal degree as described above, the target signal is subjected to the bandwidth extending process with high accuracy so that high speech quality can be maintained. Since the non-target signal does not need to be subjected to the bandwidth extending process with high accuracy, the simple bandwidth extending process is performed, so that the computational load can be reduced.

Third Embodiment

Figure 18:
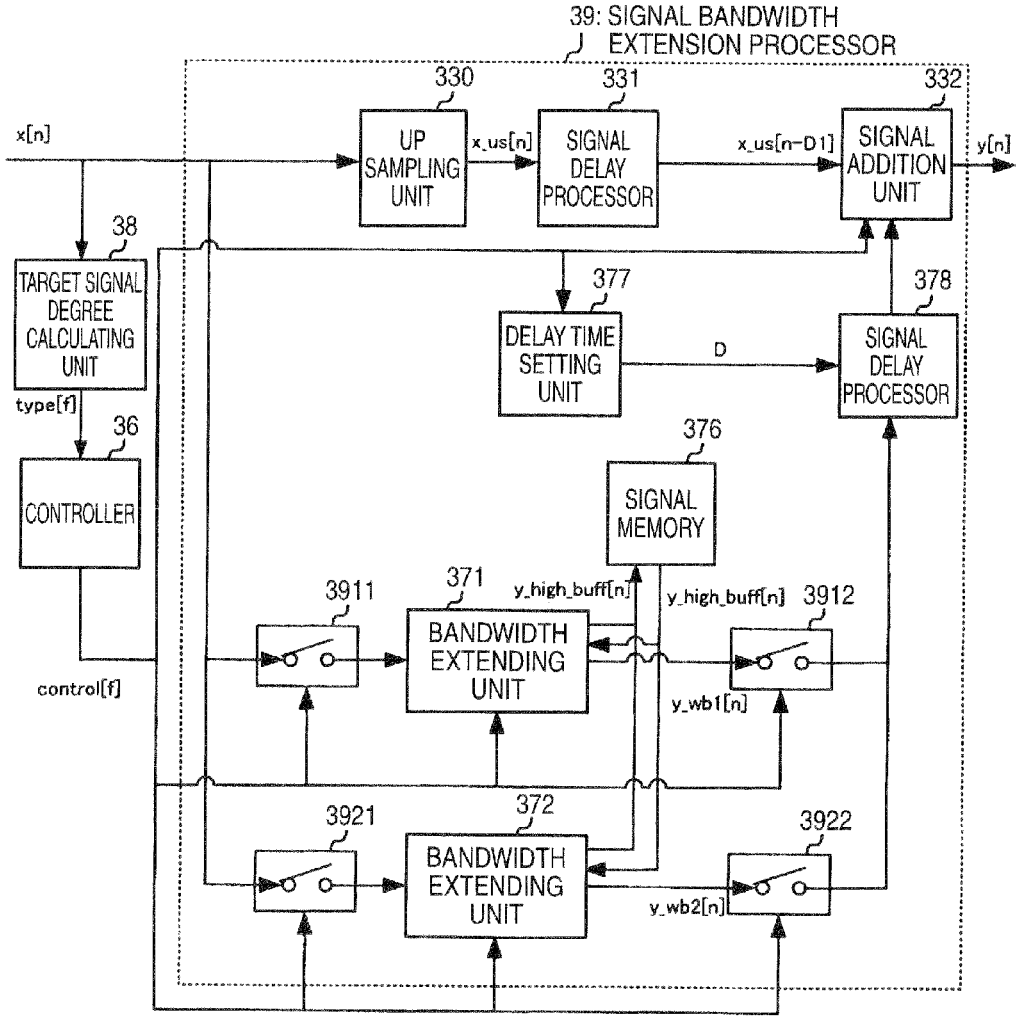
FIG. 18 is a circuit block diagram illustrating a configuration of a signal bandwidth extending unit of a signal bandwidth extending apparatus according to a third embodiment of the invention.

Next, a third embodiment of the invention will be described now. Since the configuration of this embodiment is the same as that of the first embodiment described with reference to FIGS. 1A and 1B, the description thereof will be omitted. FIG. 18 shows the configuration of the signal bandwidth extending unit 3 according to this embodiment. Further, in the following description, the same configurations as those of the above-mentioned embodiment are designated by the same reference numerals. For convenience of explanation, the description already given will be omitted as needed.

In the third embodiment, the signal bandwidth extending unit 3 is configured to use a target signal degree calculating unit 38 instead of the target signal degree calculating unit 31 of the signal bandwidth extending unit 3 according to the first embodiment, and a signal bandwidth extension processor 39 instead of the signal bandwidth extension processor 33 according to the first embodiment. In addition, the signal bandwidth extension processor 39 of the signal bandwidth extending unit 3 is configured to use the bandwidth extending unit 371 and the bandwidth extending unit 372 instead of the high-frequency bandwidth extending unit 334, and the low-frequency bandwidth extending unit 337 which are used by the signal bandwidth extending unit 33 according to the first embodiment. In addition, the signal bandwidth extending unit 3 is configured to add the signal memory 376, the delay time setting unit 377, and the signal delay processor 378.

The signal bandwidth extending unit 3 according to the first and second embodiments described above performs the low-frequency bandwidth extension and the high-frequency bandwidth extension. However, in the third embodiment, only the function for performing the extension regarding the high frequency band is provided.

That is, in the third embodiment, the input signal x[n] (n=0, 1, . . . , N−1) of the signal bandwidth extending unit 3 is limited in the bandwidth from fs_nb_low [Hz] to fs_nb_high [Hz], and the sampling frequency is changed from the sampling frequency fs [Hz] to a higher sampling frequency fs' [Hz] by the bandwidth extending process of the signal bandwidth extending unit 3 so as to be extended to the bandwidth from fs_wb_low [Hz] to fs_wb_high [Hz]. In the following description, fs_wb_low is set to fs_nb_low and fs_nb_high is less than fs_wb_high, for example, fs=22050 [Hz], fs'=44100 [Hz], fs_nb_low=50 [Hz], fs_nb_high=11000 [Hz], fs_wb_low=50 [Hz], and fs_wb_high=22000 [Hz]. The frequency band of the bandwidth limitation and the sampling frequency are not limited to the above values. Further, in this case, one frame is assumed to correspond to N samples (N=1024).

Figure 19:
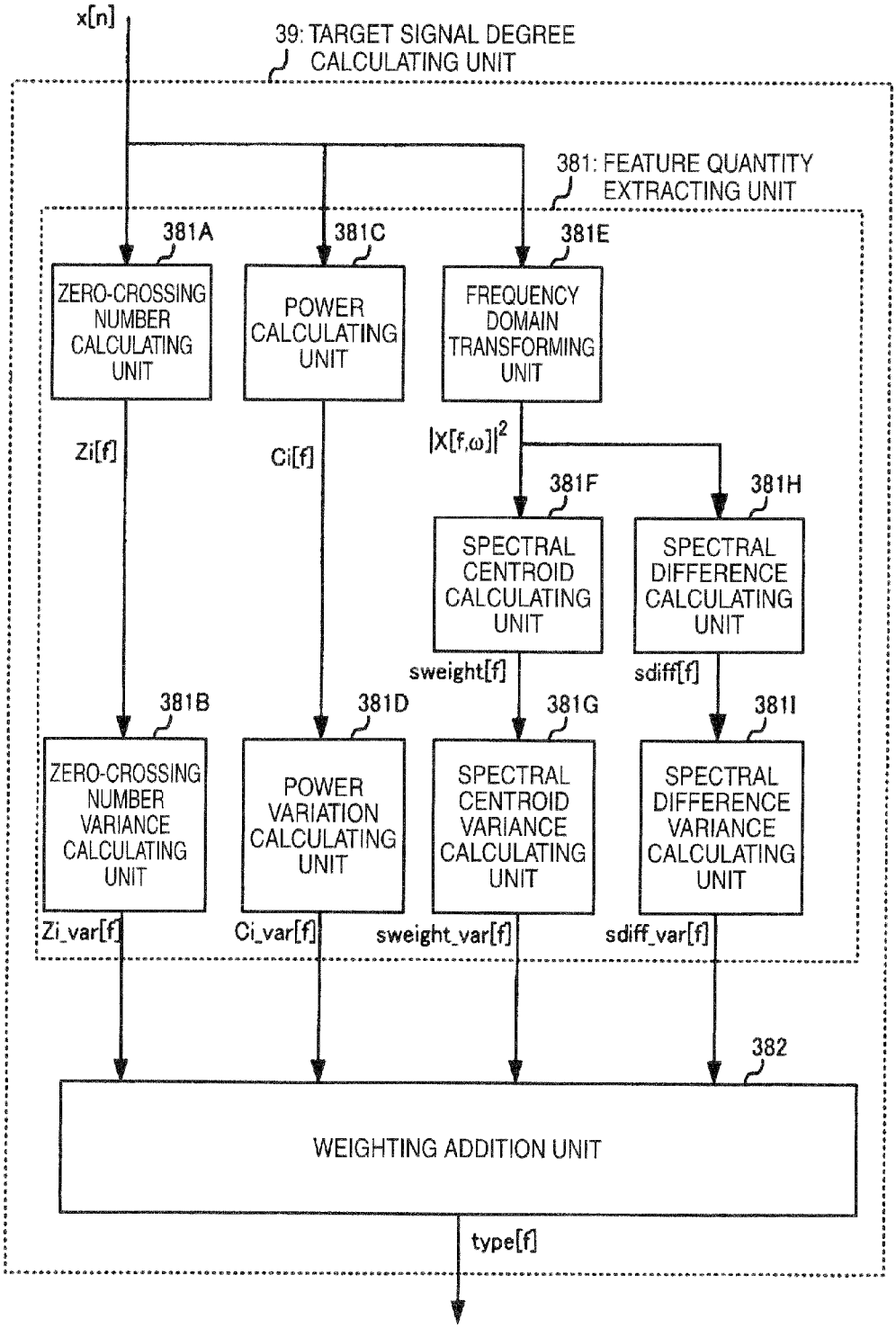
FIG. 19 is a circuit block diagram illustrating an exemplary configuration of a target signal degree calculating unit of a signal bandwidth extending unit shown in FIG. 18.

FIG. 19 shows an exemplary configuration of the target signal degree calculating unit 38. The target signal degree calculating unit 38 is provided with a feature quantity extracting unit 381 and a weighting addition unit 382. The feature quantity extracting unit 381 is provided with a zero-crossing number calculating unit 381A, a zero-crossing number variance calculating unit 381B, a power calculating unit 381C, a power variation calculating unit 381D, a frequency domain transforming unit 381E, a spectral centroid calculating unit 381F, a spectral centroid variance calculating unit 381G, a spectral difference calculating unit 381H, and a spectral difference variance calculating unit 381I.

The target signal degree calculating unit 38 calculates the target signal degree type[f] which represents the degree of the target signal to which the input signal x[n] is extended. In this embodiment, the target signal to be extended is assumed to be music and audio signals. The music signal as the target signal and the non-target signal (noise components, echo components, reverberation components, music, etc.) other than the music signal are mixed in the input signal x[n]. That is, the target signal degree calculating unit 38 outputs the target signal degree type[f] which represents how many of the music signals which are the target signals are included in the input signal x[n] in each input frame. As the feature quantity for calculating the target signal degree type[f] is not particularly limited as long as the feature quantity represents that how many of the music signals are included in the input signal such as the regularity of switching of the voiced sound such as a vowel or the unvoiced sound such as a consonant of the speech signal, or the uniformity of power spectrums of the music signal.

The zero-crossing number calculating unit 381A calculates the zero-crossing number in frame units from the input signal x[n], and divides the zero-crossing number by the frame length to take an average and thus the average zero-crossing number Zi[f] is calculated.

The zero-crossing number variation calculating unit 381B receives the average zero-crossing number Zi[f] of the current frame f output from the zero-crossing number calculating unit 381A. The zero-crossing number variation calculating unit 381B calculates the zero-crossing number variation value Zi_var[f] which is the variation of the average zero-crossing number Zi[f] of every frame, as shown in Expression 9, using the average zero-crossing number Zi[f] of the past F frames, and outputs the zero-crossing number variation value Zi_var [f]. The frame number F of the past average zero-crossing number Zi[f] which is used by the zero-crossing number variation calculating unit 381B is assumed to be 20, for example. The average zero-crossing number variation value Zi_var[f] is a value of 0 or more, and the speech signal has the regularity of switching of the voiced sound such as a vowel or the unvoiced sound such as a consonant. Therefore, in the speech signal, the change in the zero-crossing number is not too much. It is determined that, as the value is increased, the speech components increase in the input signal; many non-target signals are included; and the music signal as the target signal is small.

[Expression 9]

$$\text{Zi_var}[f] = \frac{1}{F}\sum_{i=0}^{F-1}\left(Zi[f-i] - \frac{\sum_{j=0}^{F-1} Zi[f-j]}{F}\right)^2 \tag{9}$$

The power calculating unit 381C calculates the square sum of the input signal x[n] in dB units from the input signal x[n] in frame unit, as shown in Expression 10, and outputs the resulting value as the frame power Ci[f].

[Expression 10]

$$Ci[f] = 10\log_{10}\left(\sum_{n=0}^{N-1} x[n]\cdot x[n]\right) \tag{10}$$

The power variation calculating unit 381D receives the frame power Ci[f] of the current frame f which is output from the power calculating unit 381C. The power variation calculating unit 381D outputs the power variation value Ci_var[f] which is the variation of the frame power Ci[f] in each frame, as shown in Expression 11, using the frame power Ci[f] of the past F frames. The power variation value Ci_var[f] is a value of 0 or greater. As the power variation value increases, it is determined that, as the value is increased, the speech components increase in the input signal; many non-target signals are included; and the music signal as the target signal is small.

[Expression 11]

$$\text{Ci_var}[f] = \frac{1}{F}\sum_{i=0}^{F-1}\left(Ci[f-i] - \frac{\sum_{j=0}^{F-1} Ci[f-j]}{F}\right)^2 \tag{11}$$

The frequency domain transforming unit 381E receives the input signal x[n] (n=0, 1, . . . , N−1) of the current frame f which is limited in a narrowband, and prepares the input signal x[n] (n=0, 1, . . . , N−1) which is a total of 2N in data length by combining two frames of the input signals from the current frame and the previous one frame, performs the windowing of 2N in data length on the input signal x[n] (n=0, 1, . . . , N−1) by multiplying the input signal by a window function as the Hamming window, calculating the input signal wx[n] (n=0, 1, . . . , 2N−1) obtained by the windowing, carries out the frequency domain transformation by the FFT of which degree is set to 2N, calculates the frequency spectrum X[f, w] (w=0, 1, . . . , M−1), and outputs the power spectrum |X[f, w]|2 (w=0, 1, . . . , M−1). In this case, w represents the number of the frequency bin (w=0, 1, . . . , 2M−1). Further, the input signal of the previous one frame is kept using the memory provided at the frequency domain transforming unit 381E. Here, for example, the overlap which is the ratio of the data length (here, which corresponds to 2N samples) of the windowed input signal wn[n] to the shift width (here, which corresponds to N samples) of the input signal x[n] in next time (frame) is 50%. In this case, the window function used in the windowing is not limited to the hamming window, but other symmetric windows (hann window, B lackman window, sine windows, etc.) or asymmetric windows which are used in a speech encoding process may be properly used. In addition, the overlap is not limited to 50%.

The spectral centroid calculating unit 381F calculates the power spectra centroid in frame units as shown in Expression 12 by using the power spectrum |X[f, w]|2 which is output from the frequency domain transforming unit 381E, and outputs the calculated power spectral centroid as the spectral centroid sweight[f].

[Expression 12]

$$sweight[f] = \frac{\sum_{\omega=0}^{M-1} (|X[f, \omega]|^2 \cdot (\omega + 1))}{\sum_{\omega=0}^{M-1} |X[f, \omega]|^2} \tag{12}$$

The spectral centroid variation calculating unit 381G receives the spectral centroid sweight[f] of the current frame f which is output from the spectral centroid calculating unit 381F. The spectral centroid variation calculating unit 381G calculates and outputs the spectral centroid variation value sweight_var[f] which is the variation of the spectral centroid sweight[f] in each frame as shown in Expression 13, using the spectral centroid sweight[f] of the past F frames. The spectral centroid variation value sweight_var[f] is a value of 0 or greater. The power spectrum of the music signal is uniform, easy to be stable, and the change in the spectral centroid is small. It is determined that, as the value is increased, the speech components increase in the input signal; many non-target signals are included; and the music signal as the target signal is small.

[Expression 13]

$$\text{sweight_var}[f] = \frac{1}{F}\sum_{i=0}^{F-1}\left(sweight[f-i] - \frac{\sum_{j=0}^{F-1} sweight[f-j]}{F}\right)^2 \tag{13}$$

The spectral difference calculating unit 381H calculates the square of sum of difference of the power spectrum of every frequency bin which is normalized by the power, as shown in Expression 14, using the power spectrum $|X[f-1, w]|^2$ from the previous one frame, and outputs the calculated value as the spectral difference sdiff[f]

[Expression 14]

$$sdiff[f] = \sum_{\omega=0}^{M-1}\left(\frac{|X[f, \omega]|^2}{\sum_{\omega=0}^{M-1} |X[f, \omega]|^2} - \frac{|X[f-1, \omega]|^2}{\sum_{\omega=0}^{M-1} |X[f-1, \omega]|^2}\right)^2 \tag{14}$$

The spectral difference variation calculating unit 381I receives the spectral difference sdiff[f] of the current frame f which is output from the spectral difference calculating unit 381H. The spectral difference variation calculating unit 381I calculates the spectral difference variation value sdiff_var[f] which is the variance of the spectral difference sdiff[f] in each frames as shown in Expression 15, using the spectral difference sdiff[f] of the past F frames. The spectral difference variance value sdiff_var[f] is a value of 0 or greater. It is determined that, as the value is increased, the speech components increase; many non-target signals are included; and the music signal as the target signal is small.

[Expression 15]

$$\text{sdiff_var}[f] = \frac{1}{F}\sum_{i=0}^{F-1}\left(sdiff[f-i] - \frac{\sum_{j=0}^{F-1} sdiff[f-j]}{F}\right)^2 \tag{15}$$

The weighting addition unit 382 receives the plural feature quantities extracted by the feature quantity extracting unit 381 (the zero-crossing variation value Zi_var[f] output from the zero-crossing variation calculating unit 381B, the power variation value Ci_var[f] output from the power variation calculating unit 381D, the spectral centroid variation value sweight_var[f] output from the spectral centroid variation calculating unit 381G, and the spectral difference variation value sdiff_var[f] output from the spectral difference variation calculating unit 381I). The weighting addition unit 382 performs the weighting on the input plural feature quantities with predetermined weight values, and thus the target signal degree type[f] is calculated which is the sum of weight values of the plural feature quantities. Here, as the target signal degree type[f] becomes smaller, it is assumed that the non-target signal is predominantly included, and on the other hand as the target signal degree type[f] becomes larger the target signal is predominantly included. For example, the weighting addition unit 382 sets the weight values w1, w2, w3, and w4 (where, w1≤0, w2≤0, w3≤0, and w4≤0) to the values which is obtained by being previously learned in a learning algorithm which uses the determination of a linear discriminant function, and calculates the target signal degree type[f] as type[f]=w1·Zi_var[f, 1]+w2·Ci_var[f]+w3·sweight_var[f]+w4·sdiff_var[f]. Of course, the target signal degree type[f] is not limited to be expressed by the first linear sum of the feature quantities but may be expressed as the linear sum of the multiple degrees or the expression including multiplication terms of the plural feature quantities.

The controller 36 according to the third embodiment receives the target signal degree type[f] which is output from the target signal degree calculating unit 38. The controller 36 outputs the control signal control[f] which controls the bandwidth extending unit 371 and the bandwidth extending unit 372 so as to operate or not operate according to the target signal degree type[f]. Specifically, when the control signal control[f] is set to 0, the switches 3911, 3912, 3921, and 3922 are opened, and the bandwidth extending units 371 and 372 do not operate. When the control signal control[f] is set to 1, only the switches 3911 and 3912 are closed, and only the bandwidth extending unit 371 operates. When the control signal control[f] is set to 2, the switches 3921 and 3922 are closed, and only the bandwidth extending unit 372 operates.

The bandwidth extending unit 371 according to the third embodiment has the same configuration as that of the bandwidth extending unit 371 described above with reference to FIG. 12. The bandwidth extending unit 371 receives the input signal x[n], and outputs the wideband signal y_wb1[n] which is extended to the frequency bandwidth from fs_nb_high [Hz]

to fs_wb_high [Hz] in a high frequency band. In addition when operating, the bandwidth extending unit 371 outputs the temporal second half data of y1_wb1[n], which is output from the band widening processor 334H, as the high-frequency bandwidth extending data y_high_buff[n] to the signal memory 376.

The bandwidth extending unit 372 according to the third embodiment has the same configuration as that of the bandwidth extending unit 372 described above with reference to FIG. 13. The bandwidth extending unit 372 receives the input signal x[n], and outputs the wideband signal y_wb2[n] which is extended to the frequency bandwidth from fs_nb_high [Hz] to fs_wb_high [Hz] in a high frequency band. In addition, when operating, the bandwidth extending unit 372 outputs the temporal second half data of y1_wb2[n], which is output from the signal addition unit 334M, as the high-frequency bandwidth extending data y_high_buff[n] to the signal memory 376.

When any one of the bandwidth extending units 371 and 372 is operating, the signal memory 376 receives the high-frequency bandwidth extending data y_high_buff[n] from one of the operating bandwidth extending units 371 and 372. In addition, when the bandwidth extending units 371 and 372 do not operate, the signal memory 376 sets both the high-frequency bandwidth extending data y_high_buff[n] as the zero signal. Then, in a case of the first frame when the control signal control[f] is switched from 1 to 2, the signal memory 376 properly outputs the high-frequency bandwidth extending data h_high_buff[n] (which is substantially the signal from the previous one frame) to one of the operating bandwidth extending units 371 and 372.

The delay time setting unit 377 according to the third embodiment has a different process delay time according to which one of the bandwidth extending units 371 and 372 is used to extend the bandwidth. Therefore, the process delay times taken from the input to the output of the bandwidth extending process are obtained in advance with respect to the respective bandwidth extending units 371 and 372; and the maximum delay time D_max among the process delay times is obtained. It is determined which one of the bandwidth extending units 371 and 372 is used to extend the bandwidth according to the control signal control[f] output from the controller 36. Thus, even when any one of the bandwidth extending units 371 and 372 is operating, the predetermined delay time is set as the signal delay time D which is taken in the signal delay processor 378 such that the delay time is matched with the maximum delay time D_max. For example when the delay times taken from the input to the output of the bandwidth extending units 371 and 372 are respectively assumed as D21 and D22 samples, among these the maximum delay time D_max is obtained. The delay time D is set such that when the bandwidth extending unit 371 operates, D is set to D_max−D21; when the bandwidth extending unit 372 operates, D is set to D_max−D22. Further, when the bandwidth extending units 371 and 372 do not operate, the delay time setting unit 377 does not operate.

The signal delay processor 378 according to the third embodiment sets the wideband signal output by any one of the bandwidth extending units 371 and 372 to y_wb[n], delays the wideband signal by buffering for only a predetermined time (D samples) which is set by the delay time setting unit 377, and outputs the accumulated signal as y_wb[n−D]. Further, when the bandwidth extending units 371 and 372 do not operate, the signal delay processor 378 does not operate.

As described above, even when music and audio signals are the target signal, the degree of the target signal in the input signal is calculated. According to the result of the target signal degree calculating unit, as the degree of the target is lowered, control is performed to simplify the extending of the bandwidth.

However, according to the signal bandwidth extending apparatus having the configuration described above, when music and audio signals which are the target signal and other non-target signals (noise components echo components, reverberation components, music etc.) are mixed in the input signal the bandwidth extension process cannot be always preformed with high accuracy. Furthermore, the method of the bandwidth extension process can be changed according to the target signal degree which represents how many of the music and audio signals which are the target signal are included in the input signal. Therefore, when the target signal degree is high, it is possible to extend the bandwidth to be closer to the original sound by performing the bandwidth extending process on the target signal with high accuracy, so that the high speech quality can be maintained. When the target signal degree is low, the performing of the bandwidth extending process is simplified, so that the computational load can be reduced.

Further, the invention is not limited to the embodiments described above, but various changes can be implemented in the constituent components without departing from the scope of the invention. In addition, the plural constituent components disclosed in the embodiments can be properly put into practice by combination with each other, so that various inventions can be implemented. In addition, for example, the configuration, in which some components are removed from the entire constituent components shown in the embodiments, can also be considered. Furthermore, the constituent components described in other embodiments may be properly combined.

Of course, the bandwidth extending process may be configured so as to not change the sampling frequency. Alternatively, the bandwidth extending process may be configured to extend the signal to an inaudible frequency hand. In addition, the bandwidth extending process may also configured to cite a dictionary which represents the correspondence between the feature quantity of the narrowband and the feature quantity of the wideband using the multi-resolution analysis by the discrete wavelet transform or the like.

In addition, when the bandwidth extending process is switched, the switching is carried out with continuity in consideration of the transient switching state (that is, by soft-decision) without using the binary determination by the switch and thus the wideband signals obtained from the plural bandwidth extending processes are weighted and added. Therefore, the output signal may be obtained. Furthermore, it may also be configured such that both the speech signal and the music and audio signal are set to the target signal; other signals such as the noises are set to the non-target signal; and the calculation of the speech signal degree and the calculation of the music and audio signal degree are used together.

In addition, even though the input signal is a monaural signal or a stereo signal, the bandwidth extending process of the signal bandwidth extending unit 3 is performed on an L (left) channel and an R (right) channel, or the bandwidth extending process described above is performed on the sum signal (the sum of the signals of the L channel and the R channel) and the subtraction signal (the subtraction of the signals of the L channel and the R channel), for example. Therefore, the same effect can be obtained. Of course, even though the input signal is the multichannel signal, the bandwidth extending process described above is similarly performed on the respective channel signals for example, and thus the same effect can be obtained.

Besides, it is matter of course that even when various changes are made in the invention without departing from the scope of the invention, it can be similarly implemented.

What is claimed is:

1. A signal bandwidth extending apparatus comprising a hardware processor, wherein the hardware processor is configured to function as sections comprising:

a bandwidth extending section configured to extend a frequency bandwidth of a target sound signal, the target sound signal being included in an input sound signal;

a calculating section configured to calculate a degree to which the target sound signal is included in the input sound signal, the degree being a value representing how much of the input sound signal is made up of the target sound signal; and a controller configured to change a method of extending the frequency bandwidth by the bandwidth extending section based on a result of the calculating section;

wherein the controller is configured to control the bandwidth extending section so as to (i) extend the target sound signal to a first frequency bandwidth in a first processing unit size, when the degree to which the target sound signal is included in the input sound signal is smaller than a first threshold value, (ii) extend the target sound signal to a second frequency bandwidth that is wider than the first frequency bandwidth in the first processing unit size, when the degree to which the target sound signal is included in the input sound signal is larger than the first threshold value and smaller than a second threshold value, and (iii) extend the target sound signal to the second frequency bandwidth in a second processing unit size that is smaller than the first processing unit size, when the degree to which the target sound signal is included in the input sound signal is smaller than the second threshold value.

2. The signal bandwidth extending apparatus according to claim 1, wherein the controller is configured to control the bandwidth extending section so as to (i) extend a high frequency band when the degree to which the target sound signal is included in the input sound signal is smaller than the first threshold value, and (ii) extend a high frequency band and a low-frequency band when the degree to which the target sound signal is included in the input sound signal is larger than the first threshold value.

3. The signal bandwidth extending apparatus according to claim 1, wherein the controller is configured to control the bandwidth extending section so as not to extend a low-frequency band when the degree to which the target sound signal is included in the input sound signal is smaller than the first threshold value.

4. The signal bandwidth extending apparatus according to claim 3, wherein the processor is further configured to function as sections comprising:

a signal memory section configured to store a sound signal of which a frequency bandwidth is extended; and a smoothing section configured to smooth the sound signal of which the frequency bandwidth is extended by the bandwidth extending section, with a sound signal of which a frequency bandwidth has previously been extended, wherein, when the controller controls the bandwidth extending section so as to change the method of extending the frequency bandwidth, the smoothing section is configured to smooth the sound signal of which the frequency bandwidth is extended by the bandwidth extending section, using the signal stored in the signal memory section.

5. The signal bandwidth extending apparatus according to claim 1, wherein the processor is further configured to function as sections comprising:

a signal memory section configured to store a sound signal of which a frequency bandwidth is extended; and a smoothing section configured to smooth the sound signal of which the frequency bandwidth is extended by the bandwidth extending section, with a sound signal of which a frequency bandwidth has previously been extended, wherein, when the controller controls the bandwidth extending section so as to change the method of extending the frequency bandwidth, the smoothing section is configured to smooth the sound signal of which the frequency bandwidth is extended by the bandwidth extending section, using the sound signal stored in the signal memory section.

6. A signal bandwidth extending apparatus comprising a hardware processor, wherein the hardware processor is configured to function as sections comprising:

a bandwidth extending section configured to extend a frequency bandwidth of an input sound signal including a speech signal;

a calculating section configured to calculate a degree to which the speech signal is included in the input sound signal based on an SN ratio and an autocorrelation, the degree being a value representing how much of the input sound signal is made up of the speech signal; and a controller configured to control the bandwidth extending section to extend the frequency bandwidth by a more simplified process as the degree to which the speech signal is included in the input sound signal becomes smaller;

wherein the controller is configured to control the bandwidth extending section so as to (i) extend the speech signal to a first frequency bandwidth in a first processing unit size, when the degree to which the speech signal is included in the input sound signal is smaller than a first threshold value, (ii) extend the speech signal to a second frequency bandwidth that is wider than the first frequency bandwidth in the first processing unit size, when the degree to which the speech signal is included in the input sound signal is larger than the first threshold value and smaller than a second threshold value, and (iii) extend the speech signal to the second frequency bandwidth in a second processing unit size that is smaller than the first processing unit size, when the degree to which the speech signal is included in the input sound signal is smaller than the second threshold value.

* * * * *